US007950202B2

(12) United States Patent
Kodama et al.

(10) Patent No.: US 7,950,202 B2
(45) Date of Patent: May 31, 2011

(54) MEDICINE PACKING DEVICE

(75) Inventors: Tsuyoshi Kodama, Toyonaka (JP); Katsunori Yoshina, Toyonaka (JP); Koji Yamashita, Toyonaka (JP)

(73) Assignee: Yuyama Mfg. Co., Ltd., Osaka (JP)

( * ) Notice: Subject to any disclaimer, the term of this patent is extended or adjusted under 35 U.S.C. 154(b) by 0 days.

(21) Appl. No.: 12/741,199

(22) PCT Filed: Oct. 30, 2008

(86) PCT No.: PCT/JP2008/069733

§ 371 (c)(1),
(2), (4) Date: May 3, 2010

(87) PCT Pub. No.: WO2009/057683

PCT Pub. Date: May 7, 2009

(65) Prior Publication Data

US 2010/0237089 A1 Sep. 23, 2010

(30) Foreign Application Priority Data

Nov. 2, 2007 (JP) ..... 2007-285979

(51) Int. Cl.
*B65B 5/00* (2006.01)

(52) U.S. Cl. ..... 53/247; 53/244; 53/245; 53/246; 53/248

(58) Field of Classification Search ..... 53/237, 53/244–249, 260; 209/655, 698, 707; 221/263, 221/265, 289, 292, 293, 295, 301
See application file for complete search history.

(56) References Cited

U.S. PATENT DOCUMENTS 1,227,799 A * 5/1917 Kaub ..... 312/300
3,034,684 A * 5/1962 Jackson ..... 221/301
3,545,164 A * 12/1970 Middleton ..... 53/446
(Continued)

FOREIGN PATENT DOCUMENTS

JP 53-103281 8/1978
(Continued)

OTHER PUBLICATIONS

International Search Report for PCT/JP2008/069733, mailed Jan. 13, 2009, Japanese Patent Office, 2 pages.

(Continued)

*Primary Examiner* — Rinaldi I Rada
*Assistant Examiner* — Gloria R Weeks
(74) *Attorney, Agent, or Firm* — Jones Day; Christopher C. Bolten

(57) ABSTRACT

There is provided a medicine packing device, which prevents a free end of a bottom plate of a tablet dispensing measure from tilting due to its own weight. A bottom plate 43 is provided at a lower opening of a tablet dispensing measure 42. The bottom plate 43 includes a pin 44 at its base end. A leading end of the bottom plate is a free end. When the tablet dispensing measure 42 reaches corresponding stepped portions 37*a* to 37*d* by a movement of a tablet dispensing member 36, an opening protrusion 144*b* of a fixed plate 37 is fitted to an opening recess 43*c* of the bottom plate 43 and thus the bottom plate 43 pivots about the pin 44 from a closed position to an open position. If the bottom plate 43 moves to the open position, then tablets in the tablet dispensing measure 42 drop.

8 Claims, 18 Drawing Sheets

U.S. PATENT DOCUMENTS

| | | | | | |
|---|---|---|---|---|---|
| 3,702,665 | A | * | 11/1972 | Rainey | 221/301 |
| 3,942,303 | A | * | 3/1976 | Kristiansen | 53/542 |
| 4,026,091 | A | * | 5/1977 | Pearson | 53/390 |
| 4,403,462 | A | * | 9/1983 | Halbich | 53/392 |
| 4,415,098 | A | * | 11/1983 | Haas | 221/202 |
| 4,573,606 | A | * | 3/1986 | Lewis et al. | 221/2 |
| 4,685,271 | A | * | 8/1987 | Ringer et al. | 53/246 |
| 4,693,057 | A | * | 9/1987 | Rittinger et al. | 53/539 |
| 5,117,982 | A | * | 6/1992 | Shotthafer et al. | 209/614 |
| 5,737,902 | A | * | 4/1998 | Aylward | 53/475 |
| 6,349,999 | B1 | | 2/2002 | Takahashi et al. | |
| 6,761,010 | B1 | * | 7/2004 | Gibson | 53/390 |
| 6,779,663 | B1 | * | 8/2004 | Pocsi | 206/534 |
| 7,334,699 | B2 | * | 2/2008 | Keffeler et al. | 221/93 |
| 7,472,526 | B2 | * | 1/2009 | Pearson | 53/473 |
| 7,587,878 | B2 | * | 9/2009 | Kim | 53/246 |
| 7,856,794 | B2 | * | 12/2010 | Zieher | 53/246 |
| 2003/0057231 | A1 | * | 3/2003 | Kim | 221/263 |
| 2004/0074916 | A1 | * | 4/2004 | Priebe et al. | 221/289 |
| 2008/0314002 | A1 | | 12/2008 | Yuyama et al. | |
| 2010/0107555 | A1 | * | 5/2010 | Yuyama et al. | 53/131.2 |

FOREIGN PATENT DOCUMENTS

| | | | | |
|---|---|---|---|---|
| JP | 1986-032120 | U | | 2/1986 |
| JP | 1991-200502 | A | | 9/1991 |
| JP | 5-71101 | | | 9/1993 |
| JP | 7-236998 | | | 9/1995 |
| JP | 1998-323382 | A | | 12/1998 |
| JP | 1089563 | | | 10/2000 |
| JP | 2001-335002 | | | 12/2001 |
| JP | 2004-73371 | | | 3/2004 |
| JP | 2004-115059 | | | 4/2004 |
| JP | 2006-335467 | | | 12/2006 |
| JP | 2007-8586 | | | 1/2007 |
| KR | 2001-0032554 | | | 4/2001 |
| WO | WO 2006/129620 | | * | 7/2006 |
| WO | WO 2006/129620 | A1 | | 12/2006 |
| WO | WO 2008/120657 | A1 | | 10/2008 |

OTHER PUBLICATIONS

Extended European Search Report for EP 08843866.8-2308, mailed Oct. 18, 2010, 6 pages.

* cited by examiner

MEDICINE PACKING DEVICE

CROSS-REFERENCE TO RELATED APPLICATIONS

This application is a 35 U.S.C. §371 U.S. national stage filing of International Patent Application No. PCT/JP2008/069733, filed Oct. 30, 2008, which claims the benefit of Japanese Patent Application No. 2007-285979, filed Nov. 2, 2007, the entire contents of both of which are incorporated herein by reference.

TECHNICAL FIELD

The present invention relates to a medicine packing device capable of packing solid medicines of an unpowdered type such as tablets in a narrow sense, capsular medicines and pills.

BACKGROUND ART

There are provided in the art some medicine packing devices, which pack medicines such as tablets or powdered medicines one dose at a time according to a prescription. As one example of such type of medicine packing device, a medicine packing device, which includes a tablet feeding unit feeding tablets in a so-called manual distributing manner, is known in the art (see, e.g., Patent Document 1). Specifically, such type of a tablet feeding unit includes a plurality of tablet receiving measures arranged in a matrix shape on an upper surface of a medicine packing device. An operator manually puts tablets into the tablet receiving measures. After putting the tablets is completed, a shutter constituting a bottom portion of the tablet receiving measure is opened. Then, the tablets in each of the tablet receiving measures drop into a corresponding tablet dispensing measure provided in a movable tablet dispensing member. The tablets in the tablet dispensing measure are sequentially fed to a packing unit by means of a below-described mechanism.

Referring to FIG. 17, a lower opening of each of the tablet dispensing measures 542 is provided with a bottom plate 543. A pin 544, which is supported at its both ends by the tablet dispensing measure, penetrates through a base end of the bottom plate 543. The bottom plate 543 is rotatably connected to the tablet dispensing member through the pin 544. Further, a cylindrical portion is formed around the shaft part 544. Meanwhile, a leading end of the bottom plate 543 is a free end. The bottom plate 543 is pivotable about the pin 544 between a closed position where the bottom plate closes the lower opening of the tablet dispensing measure to hold the tablets in the tablet dispensing measure (the bottom plate 543 shown in a lower part of FIG. 17) and an open position where the bottom plate opens the lower opening to drop the tablets in the tablet dispensing measure 542 to a packing unit (the bottom plate 543 shown in a upper part of FIG. 17). Below the medicine dispensing member is disposed a fixed plate 537, which supports a lower surface of the bottom plate 543 at its upper surface to maintain the bottom plate in the closed position and has stepped portions 537*a*, 537*b* at its leading end. A cylindrical portion 547 is formed at a leading end of each of the stepped portions 537*a*, 537*b*. FIG. 17 shows neighboring stepped portions 537*a*, 537*b* and the bottom plates 543 respectively corresponding thereto.

If the stepped portions 537*a*, 537*b* are situated rearward of the shaft part 544 along with movement of the tablet dispensing member, then the bottom plate 543 pivots about the pin 544 from the closed position to the open position. Specifically, as a peripheral surface of the cylindrical portion 545 of the bottom plate 543 moves along a peripheral surface of the cylindrical portion 547 of the fixed plate 537, the bottom plate 543 pivots slowly from the closed position to the open position. When a center of the cylindrical portion 545 of the bottom plate 543 passes by a center of the cylindrical portion 547 of the fixed plate 537, the bottom plate 543 goes into the fully open position.

Positioning the tablet dispensing member for placing one of the bottom plates 543 into the open position is performed only by a drive mechanism of the tablet dispensing member and both the bottom plate 543 and the stepped portions 537*a*, 537*b* of the fixed plate 537 do not contribute to such positioning. This leads to poor precision in positioning the tablet dispensing member. As such, it is necessary to ensure a sufficient distance $\alpha$ between the cylindrical portion 545 of the bottom plate 543 and the cylindrical portion 547 of the fixed plate 537 with respect to the bottom plate 43 neighboring one of the bottom plates 543 being in the open position (the bottom plate 543 shown in an upper part of FIG. 17), i.e., with respect to the bottom plate 543 next pivoting from the closed position to the open position (the bottom plate 543 shown in a lower part of FIG. 17). Specifically, in case the precision in positioning the tablet dispensing member is poor and the distance $\alpha$ is narrow, while one of the bottom plates 543 (the bottom plate 543 shown in upper part of FIG. 17) is in the open position, the peripheral surface of the cylindrical portion 545 of the bottom plate 543, which next pivots from the closed position to the open position (the bottom plate 543 shown in a lower part of FIG. 17), reaches the peripheral surface of the cylindrical portion 547 of the fixed plate 537. As a result, a downward displacement (so-called tilting) as indicated by an arrow $\beta$ in FIG. 17 occurs at a free end of the bottom plate 543*b* due to a weight of the bottom plate. Thus, the bottom plate 543*b* is slightly opened and a gap is formed therefrom. Dropping of the tablets in the tablet dispensing measure 542 through the gap may cause failure. Especially, thin tablets are apt to drop unintentionally through the gap.

The distance $\alpha$ corresponds to a pitch between the stepped portions 537*a*, 537*b* of the bottom plate 543. As such, to prevent the tablets from dropping unintentionally due to tilting of the bottom plate 543*b*, the pitch between the stepped portions 537*a*, 537*b* must be enlarged. As a result, a movement distance of the tablet dispensing member, which is required to open all the bottom plates 543, is increased and the device becomes larger accordingly.

Further, in a prior art medicine packing device of the above-mentioned type, tablets may adhere on an upper surface of the bottom plate 543 of the tablet dispensing measure or an upper surface of the above-described shutter due to a static electricity, thereby causing a failure.

Patent Document 1: Japanese Laid-Open Patent Application No. 1998-323382

SUMMARY OF THE INVENTION

Thus, it is an object of the present invention to provide a medicine packing device, which can achieve compactness of the device and high-speed packing while preventing tablets from dropping unintentionally due to a downward displacement (so-called tilting) caused by a weight of a free end of a bottom plate. Further, it is a further object of the present invention to provide a medicine packing device, which can prevent tablets from adhering on a bottom plate or a shutter plate due to a static electricity.

The present invention provides a medicine packing device comprising a tablet receiving part, a tablet dispensing part and a packing part. The tablet receiving part includes a plurality of tablet receiving measures defined in a plurality of rows in forward and backward directions and in a plurality of columns in a transverse direction. Each of the tablet receiving measures receives tablets for one pack. The tablet dispensing part removes tablets from a lower opening of the tablet receiving measure and dispenses the removed tablets one pack at a time. The packing part packs the tablets dispensed by the tablet dispensing part one pack at a time. The tablet dispensing part comprises an opening and closing mechanism, a tablet dispensing member, bottom plates, a fixed plate and a drive device. The opening and closing mechanism is disposed below the tablet receiving part to open and close the lower opening of the tablet receiving measure. The tablet dispensing member is disposed below the opening and closing mechanism and includes a plurality of tablet dispensing measures defined in a plurality of rows and in a plurality of columns to correspond to the tablet receiving measures. Each of the dispensing measures receives the tablets dropped from the lower opening of the tablet receiving measure opened by the opening and closing mechanism. The tablet dispensing member is movable in a column direction of the tablet dispensing measures. The bottom plates are provided at a lower opening of each of the tablet dispensing measures. The bottom plate includes: a shaft part rotatably connected to the tablet dispensing member at a base end thereof, a leading end thereof being a free end; and an opening recess located on a lower surface near the rotating shaft from a halfway point between the rotating shaft and the free end. The bottom plate is pivotable about the shaft part between a closed position where the bottom place closes the lower opening of the tablet dispensing measure to hold the tablets in the tablet dispensing measure and an open position where the tablets are dropped to the packing part by opening the lower opening of the tablet dispensing measure. The fixed plate is disposed below the tablet dispensing member. The fixed plate includes: stepped portions at one leading end in the column direction of the medicine dispensing measures; and an opening protrusion disengagably fitted to the opening recess of the bottom plate. Each of the stepped portions supports the lower surface of the bottom plate to maintain the bottom plate in the closed position. The drive device moves the tablet dispensing member in the column direction of the tablet dispensing measure. When the tablet dispensing measure reaches the corresponding stepped portion by a movement of the tablet dispensing member caused by the drive device, the opening protrusion of the fixed plate is fitted to the opening recess of the bottom plate. Thus, a bottom plate pivots about the shaft part from the closed position to the open position.

It is preferred that the opening protrusion includes an upper surface extending downwardly from a leading end of the opening protrusion at a first angle with respect to a horizontal direction and a lower surface extending downwardly from the leading end at a second angle greater than the first angle with respect to the horizontal direction.

According to such a configuration, once the opening recess of the bottom plate reaches the opening protrusion by the movement of the tablet dispensing member, the leading end of the opening protrusion is immediately fitted to the opening recess. Thus, the bottom plate pivots about the shaft part from the closed position to the open position due to its own weight. In other words, the bottom plate does not pivot slowly from the closed position to the open position, but pivots rapidly and completely from the closed position to the open position due to its own weight when it reaches a predetermined position. That is, a behavior or position of the bottom plate generally includes only two positions consisting of the closed and open positions and substantially does not include an intermediate state (e.g., a tilting state or a half-opened state). As such, the bottom plate does not produce a downward displacement (tilting) due to its own weight at its free end before it reaches the leading end of the stepped portions. Accordingly, it is possible to prevent the tablets from unintentionally dropping from a gap formed in the lower end of the tablet dispensing measure or further prevent a failure in packing resulting therefrom.

Further, since the opening protrusion is fitted to the opening recess of the bottom plate, the tablet dispensing member is situated with high precision. Thus, a distance between the opening recess and the opening protrusion can be set narrowly with respect to a bottom plate neighboring the bottom plate being in the open position, i.e., with respect to a bottom plate next pivoting from the closed position to the open position. Further, since the distance can be set narrowly, pitches between the stepped portions of the fixed plate can be set narrowly as well. Accordingly, it is possible to shorten a movement distance of the tablet dispensing member required to open all the bottom plates and to achieve compactness of the device.

Furthermore, since the tablet dispensing member is situated with high precision by fitting the opening protrusion to the opening recess of the bottom plate, it is possible to move the tablet dispensing member at a high speed and to enhance a speed for dispensing tablets from the tablet dispensing part to the packing part to accomplish high-speed packing.

It is preferred that an upper surface of the bottom plate is processed for enhancing surface roughness. According to such a configuration, it is possible to prevent tablets from adhering on the bottom plate due to a static electricity.

It is preferred that the opening and closing mechanism includes a pair of shutters formed with a plurality of tablet passing apertures corresponding to the tablet receiving measures. The shutters move to a closed position where upper surfaces thereof form bottom portions of the tablet receiving measures and to an open position where the tablet passing apertures communicate with the tablet receiving measures to open the lower openings of the tablet receiving measures. It is preferred that upper surfaces of closing portions of the shutters are processed for enhancing the surface roughness. According to such a configuration, it is possible to prevent tablets from adhering on the bottom plate or the shutter due to a static electricity.

According to the medicine packing device of the present invention, it is possible to prevent a gap from occurring at the lower end of the tablet dispensing measure due to the downward displacement (tilting) of the free end of the bottom plate caused by the weight of the bottom plate. Also, it is possible to prevent tablets from dropping unintentionally from the gap and further prevent failure in packing resulting therefrom. Further, with the enhanced precision in positioning the medicine dispensing member, it is possible to shorten a movement distance of the tablet dispensing member associated with the pitch between the stepped portions of the fixed plate and to accomplish compactness of the device. Also, it is possible to accomplish high-speed dispensing of tablets from the tablet dispensing part to the packing part due to a high-speed movement of the tablet dispensing member and to accomplish high-speed packing thereby. Furthermore, processing for enhancing the surface roughness can prevent tablets from adhering on the bottom plate or the shutter due to a static electricity.

DESCRIPTION OF REFERENCE NUMERALS

1 . . . Medicine Packing Device
2 . . . Tablet Feeding Unit
3 . . . Powdered Medicine Feeding Unit
4 . . . Packing Unit
5 . . . Medicine Dispensing Portion
6 . . . Housing
9 . . . Control Panel
11, 12, 13 . . . Controller
21 . . . Tablet Receiving Measure
21*a* . . . Upper Opening
21*b* . . . Lower Opening
22 . . . Tablet Receiving Part
23 . . . Tablet Dispensing Part
24*a*, 24*b* . . . Barrier Wall
25 . . . Blocking Cover
26 . . . Protection Cover
34 . . . Upper Shutter Plate
34*a* . . . Engaging Portion
35 . . . Lower Shutter Plate
35*a* . . . Engaging Portion
36 . . . Tablet Dispensing Member
37 . . . Fixed Plate
38, 39 . . . Partitioning portion
38*a*, 39*a* . . . Section
41 . . . Tablet Passing Aperture
42 . . . Tablet Dispensing Measure
43 . . . Bottom Plate
43*a* . . . Swelled Portion
43*c* . . . Opening Recess
44 . . . Pin
45 . . . Weight
51 . . . V-shaped Measure
61 . . . Packing Sheet
62 . . . Roll
63 . . . Sheet Feeding Part
65 . . . Unfolding guide
67 . . . Hopper
68 . . . Heat-sealing Part
69 . . . Printing Part
71 . . . Holding Frame
130 . . . Swelled Portion
131 . . . Protrusion
132 . . . Concavo-convex Portion
133, 134 . . . Plate Body
133*a* . . . Swelled Portion
134*a* . . . Concavo-convex Portion
144 . . . Opening Member
144*a* . . . Attachment Portion
144*b* . . . Opening Protrusion

DETAILED DESCRIPTION

Embodiments of the present invention will be described below with reference to the accompanying drawings.

Figure 1:
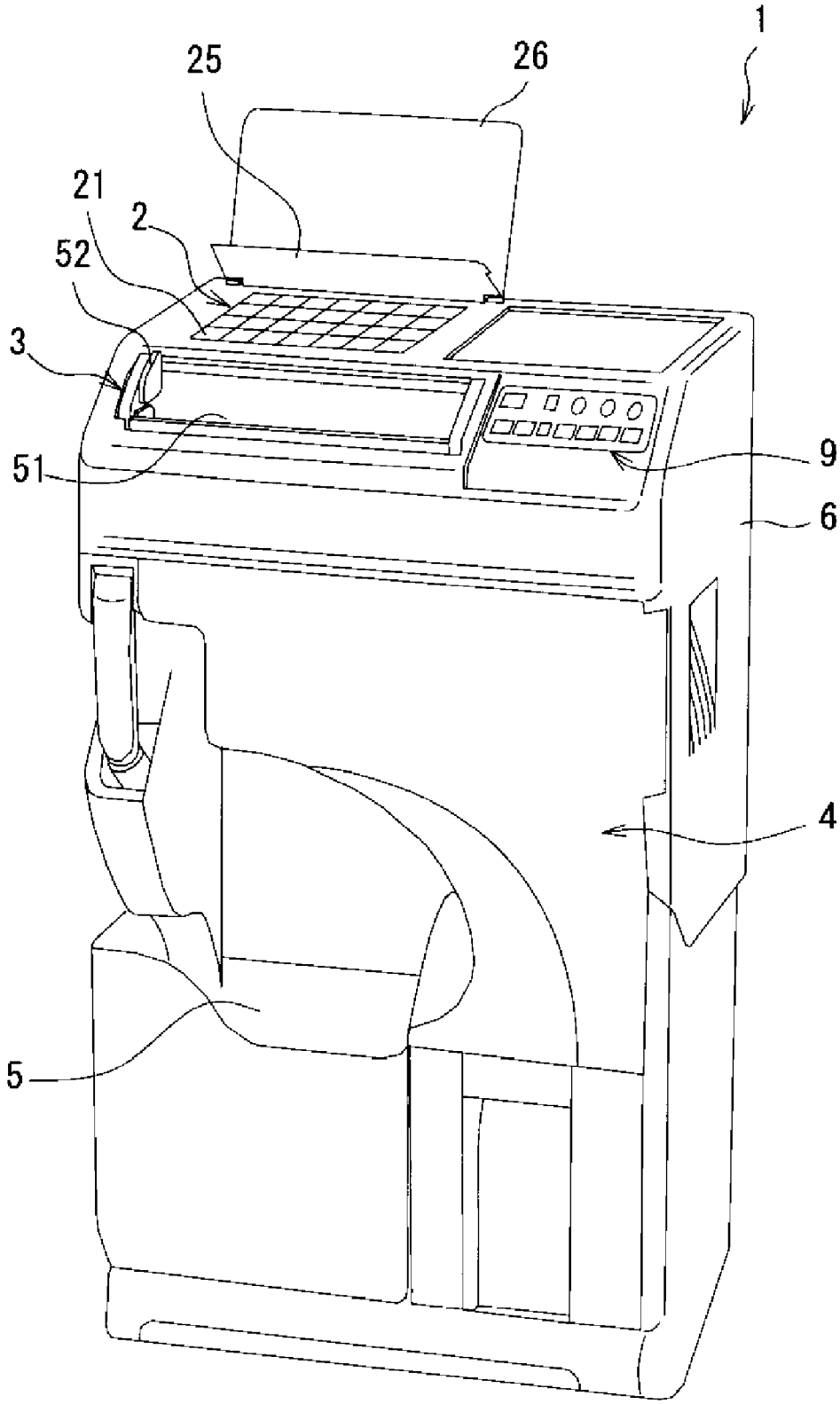
FIG. 1 is a perspective view showing a medicine packing device according to one embodiment of the present invention.

(Whole Configuration) A medicine packing device 1 according to one embodiment of the present invention, which is illustrated in FIG. 1, includes the following: a tablet feeding unit 2; a powdered medicine feeding unit 3; a packing unit 4; and a medicine dispensing portion 5 through which a packed medicine is discharged. The tablet feeding unit 2 and the powdered medicine feeding unit 3 are provided on an upper surface of a housing 6. Further, the packing unit 4 is disposed in the housing 6. A control panel 9 is provided on the upper surface of the housing 6.

Figure 2:
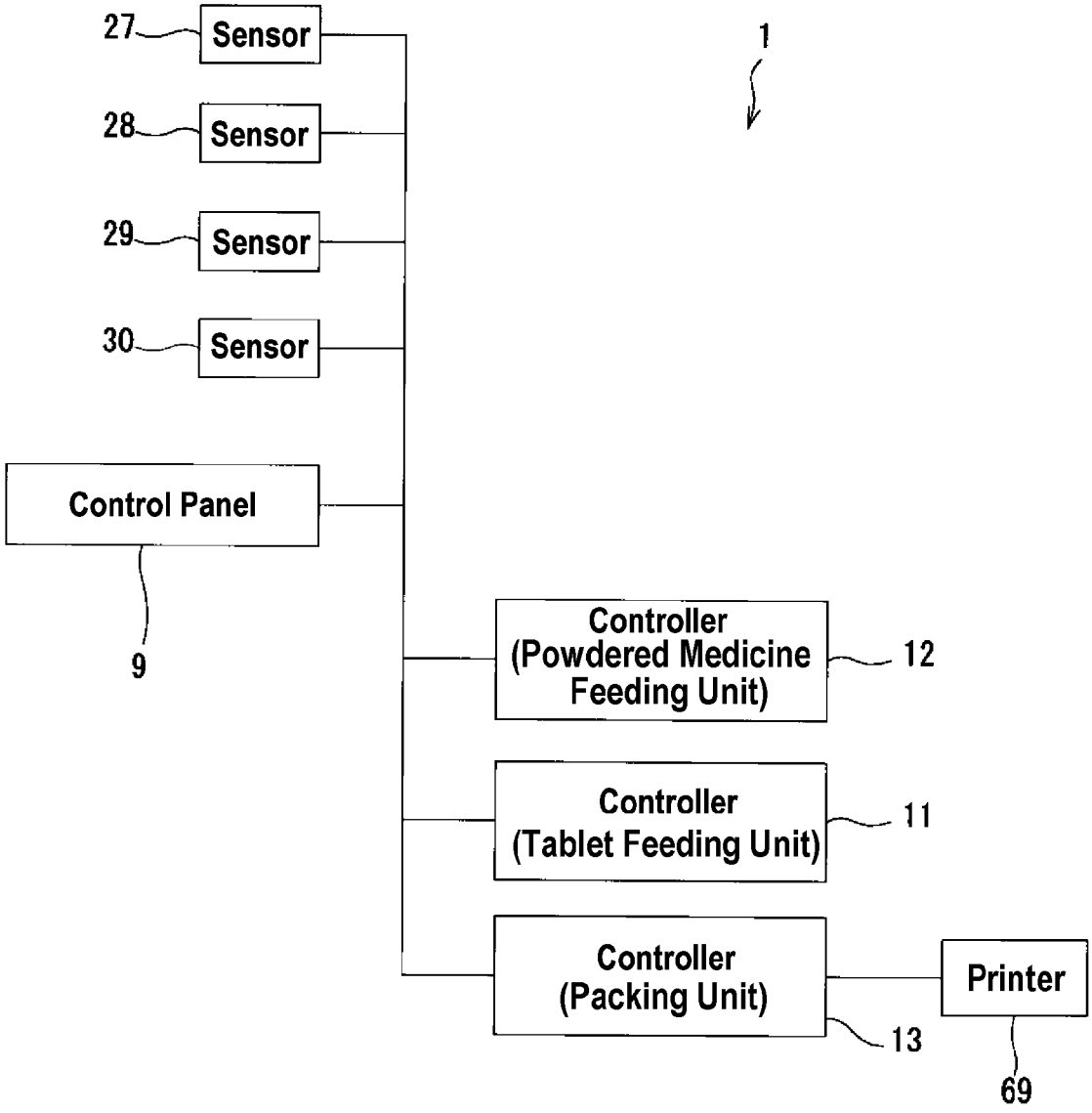
FIG. 2 is a block diagram showing a constitution of the medicine packing device according to one embodiment of the present invention.

Referring to FIG. 2, operations of the tablet feeding unit 2, the powdered medicine feeding unit 3 and the packing unit 4 are controlled by controllers 11, 12, 13 based on the following: inputs from the control panel 9; inputs from sensors 27, 28, 29, 30; and prescription information inputted from an outside. In the present embodiment, the tablet feeding unit 2 is controlled by the controller 11, the powdered medicine feeding unit 3 is controlled by the controller 12 and the packing unit 4 is controlled by the controller 13. However, two or more units among the tablet feeding unit 2, the powdered medicine feeding unit 3 and the packing unit 4 may be controlled by a common controller.

(Tablet Feeding Unit) The tablet feeding unit 2 will be described below with reference to FIGS. 3A to 15C. First, referring to FIGS. 3A to 3C, the tablet feeding unit 2 includes the following: a fixed tablet receiving part 22 in which a plurality of tablets receiving measures 21 is provided in a matrix shape (in the present embodiment, the tablet receiving part constitutes a portion of the upper surface of the housing 6); and a tablet dispensing part 23 for automatically and sequentially removing tablets for one pack, which are fed into each of the tablet receiving measures 21 in a manual distribution manner, to feed the same to the packing unit 4.

Figure 4:
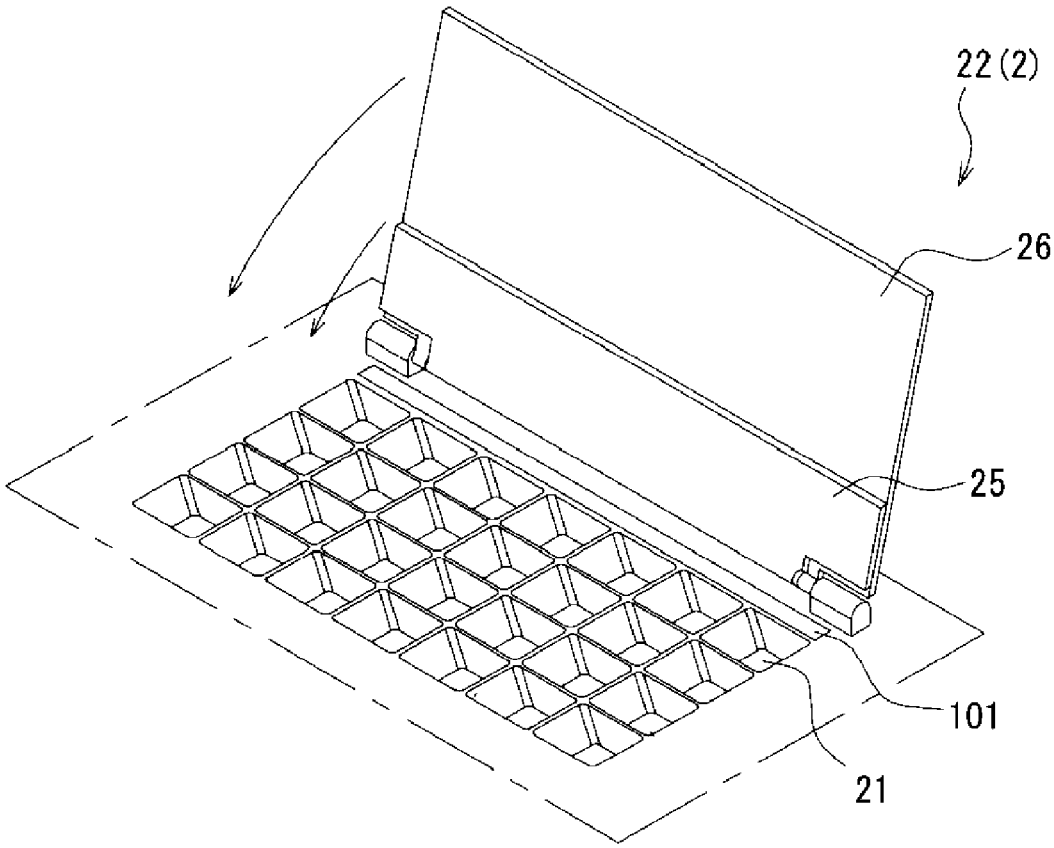
FIG. 4 is a perspective view showing a tablet receiving part.
Figure 5:
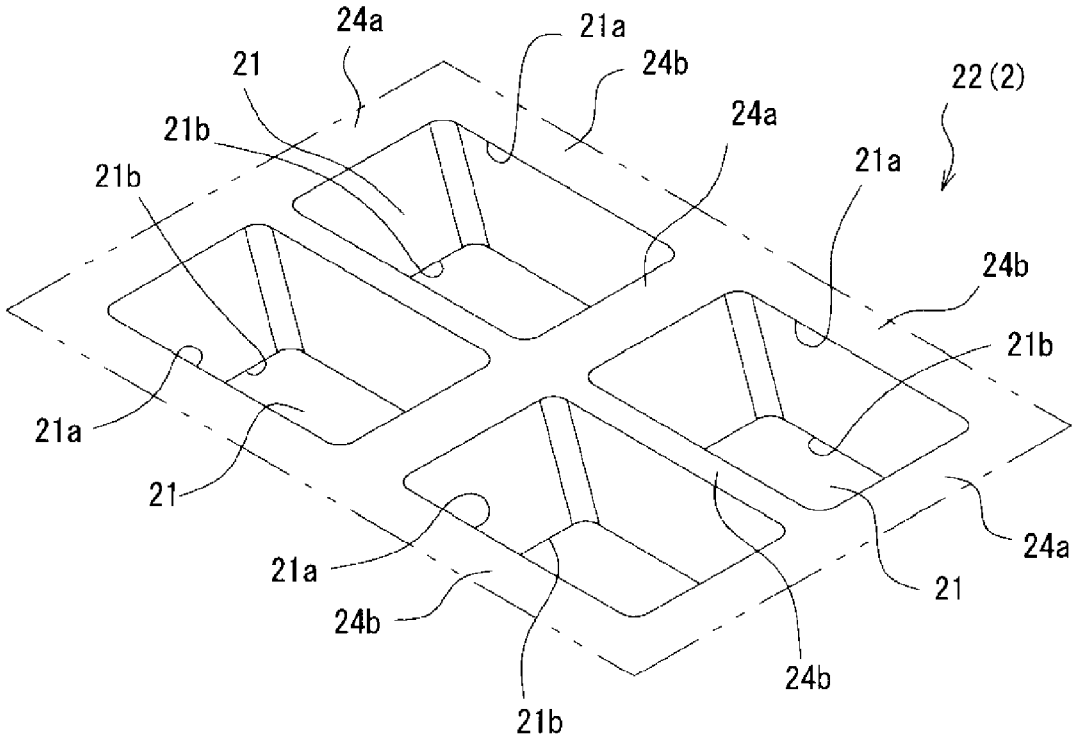
FIG. 5 is a partial enlarged view of FIG. 4.

(Tablet Receiving Part) Referring to FIGS. 1, 4 and 5, the tablet receiving part 22 according to the present embodiment is configured such that a total of twenty-eight tablet receiving measures 21 of the same shape are defined in four rows in forward and backward directions (in a row direction) and in seven columns in a transverse direction (in a column direction). The tablet receiving part 22 includes a plurality of first barrier walls 24*a* for compartmentalizing the tablet receiving measures 21 neighboring in a row direction and a plurality of second barrier walls 24*b* for compartmentalizing the tablet receiving measures 21 neighboring in a column direction. Each of the tablets receiving measures 21 is compartmentalized by the first and second barrier walls 24*a*, 24*b*. The tablet receiving measure 21 is opened at its upper and lower ends. An upper opening 21*a* serves as an opening, through which an operator manually puts tablets into the tablet receiving measure 21. A lower opening 21*b*, which is positioned opposite the upper end 21*a*, serves as an opening, through which the tablets received in the tablet receiving measure 21 pass when they are transferred to the tablet dispensing part 23.

The tablet receiving part 22 includes a blocking cover 25 of a sheet shape or a plate shape and a protection cover 26 of a sheet shape or a plate shape. When the protection cover 26 is in an open position, the blocking cover 25 is movable to an open position where it is retracted from the tablet receiving part 22 and a closed position where it is placed on the tablet receiving part 22. When the blocking cover 25 is in the open position, all of the upper openings 21*a* of the twenty-eight tablet receiving measures 21 are opened and tablets can be placed into all of the tablet receiving measures 21. Further, the blocking cover 25 is in the closed position, the upper openings 21*a* of the seven tablet receiving measures 21, which constitutes a rearmost row of the tablet receiving measures 21 in four rows and seven columns, are blocked by the blocking cover 25. As a result, the tablets can be only put into twenty-one tablet receiving measures 21 in three rows and seven columns.

(Tablet Dispensing Part) Referring to FIGS. 3A to 3C and 6, the tablet dispensing part 23 of the tablet feeding unit 2 includes the following: an upper shutter plate 34 disposed below the tablet receiving part 22; a lower shutter plate 35 disposed below the upper shutter plate 34 as overlapped and aligned to each other; a tablet dispensing member 36 movably disposed below the lower shutter plate 35; and a fixed plate 37 disposed below the tablet dispensing member 36. The fixed plate 37 is fixed with respect to the tablet dispensing member 36.

Figure 3A:
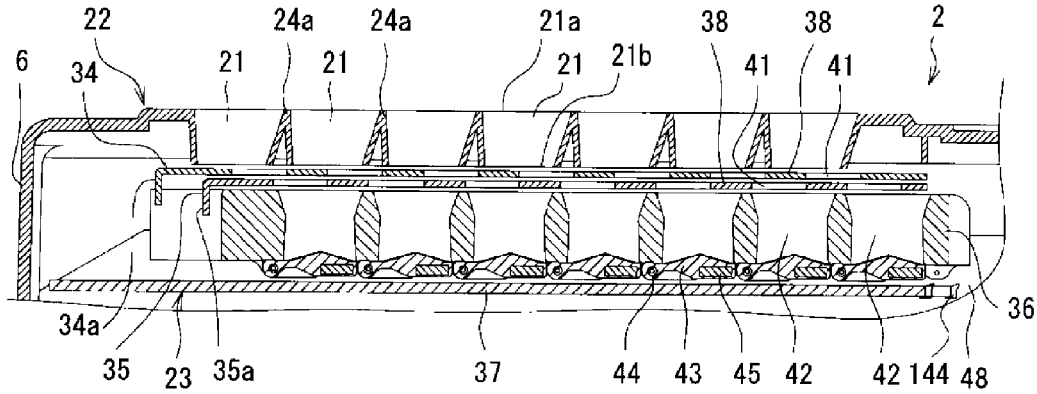
FIG. 3A is a partial sectional view showing a tablet feeding unit when a shutter is in a closed position.
Figure 3B:
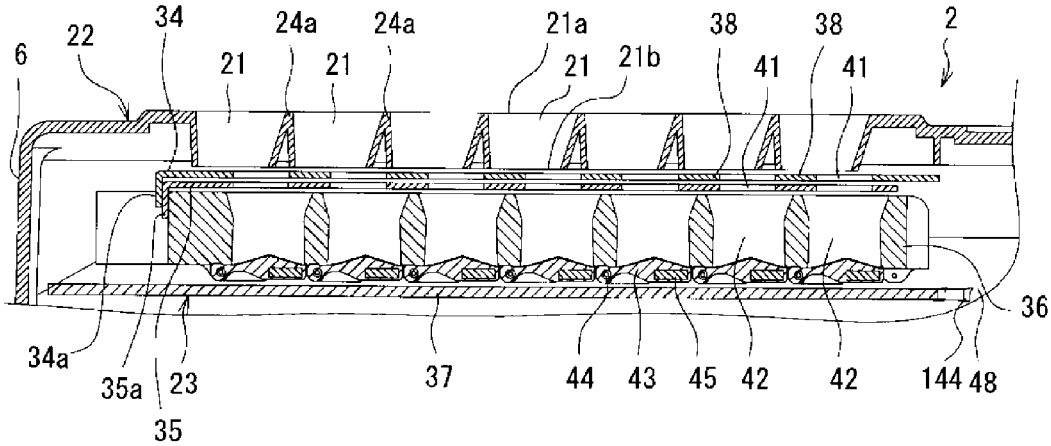
FIG. 3B is a partial sectional view showing the tablet feeding unit when the shutter is opened.
Figure 3C:
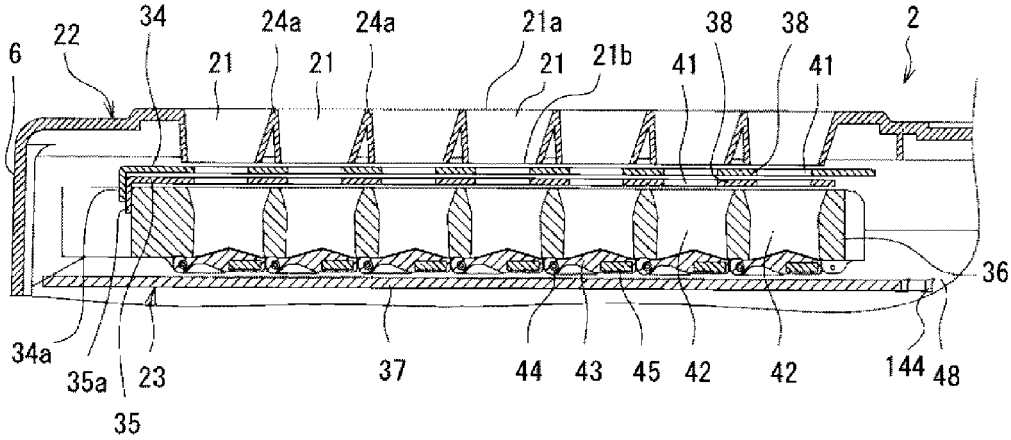
FIG. 3C is a partial sectional view showing the tablet feeding unit when the shutter is in an open position.

The upper and lower shutter plates 34, 35 are movable in the column direction of the arrangement of the tablet receiving measure 21 while maintaining their overlapped and aligned state. The upper and lower shutter plates 34, 35 are formed with twenty-eight tablet passing apertures 41 defined in four rows and seven columns, which correspond to the respective tablet receiving measures 21. The tablet passing apertures 41 are compartmentalized by a first partitioning portion 38 extending in the row direction of the arrangement of tablet receiving measure 21 and a second partitioning portion 39 extending in the column direction of the arrangement of the tablet receiving measure 21. Further, left ends of the upper and lower shutter plates 34, 35 in FIGS. 3A to 3C are provided with engaging portions 34*a*, 35*a*, which are downwardly bent. Furthermore, the upper shutter plate 34 is connected to the tablet receiving part 22 through a spring (not shown) to thereby become elastically biased rightward in FIGS. 3A to 3C. Also, the lower shutter plate 35 is connected to the upper shutter place 34 through a spring (not shown) to thereby become elastically biased rightward in FIGS. 3A to 3C.

Figure 7:
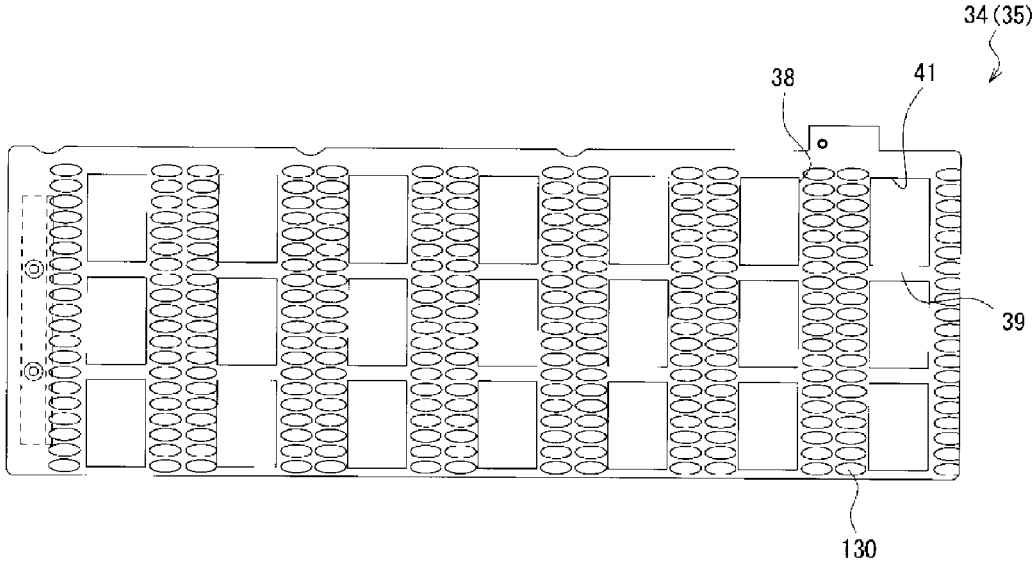
FIG. 7 is a plan view of a shutter plate.

In an initial state where no external force is applied to the upper and lower shutter plates 34, 35, as shown in FIG. 3A, the upper and lower shutter plates 34, 35 are in a closed position wherein the lower opening 21*b* of each of the tablet receiving measures 21 is closed by the first partitioning portion 38 of the upper shutter plate 34 and the first partitioning portion 38 of the lower shutter plate 35. In other words, upper surfaces of the first partitioning portions 38 of the upper shutter plate 34 and the lower shutter plate 35 form a bottom portion, which closes the lower opening 21*b* of the tablet receiving measure 21. As shown in FIG. 7, the upper surfaces of the first partitioning portions 38 of the upper shutter plate 34 and the lower shutter plate 35 are formed with a plurality of swelled portions 130 having a flat elliptical sphere shape formed by embossing for enhancing surface roughness. Providing those swelled portions 130 can prevent the tablets, which is put into the tablet receiving measure 21, from adhering on the upper surfaces of the first partitioning portions 38, 39 of the upper shutter plate 34 and the lower shutter plate 35 due to a static electricity. Regarding such an anti-adhesion, it is believed that the tablets are in contact with a top end of the swelled portion 130, thereby decreasing a contact area between the tablets and the upper and lower shutter plates 34, 35. Further, it is believed that small gaps are formed between the tablets and the upper and lower shutter plates 34, 35 due to decrease in the contact area and a corona discharge is caused in such a small gap.

Figure 8A:
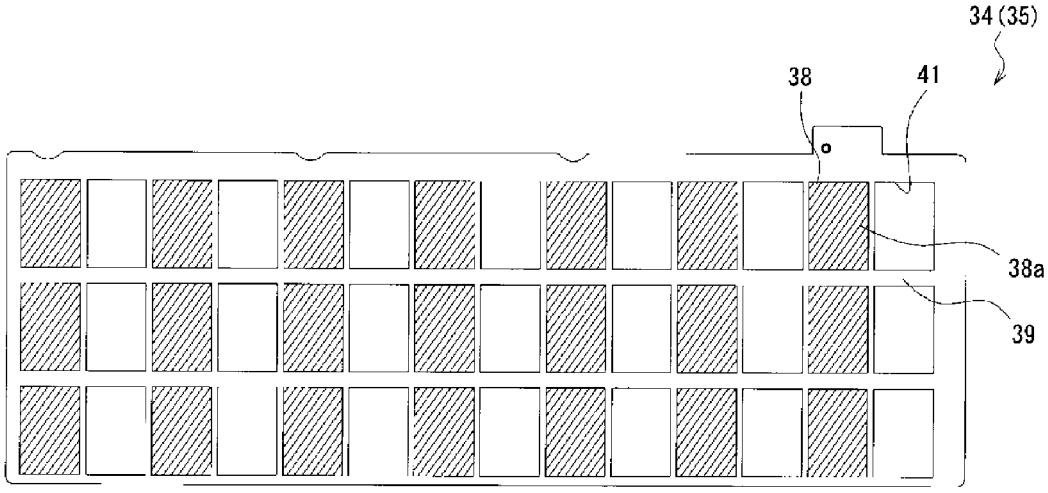
FIG. 8A is a plan view of an alternative shutter plate.
Figure 8B:
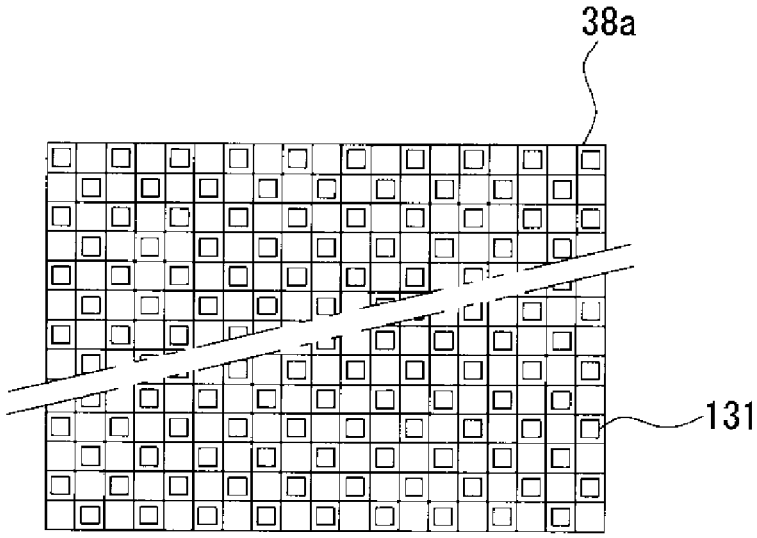
FIG. 8B is a partial enlarged view of FIG. 8A.
Figure 8C:
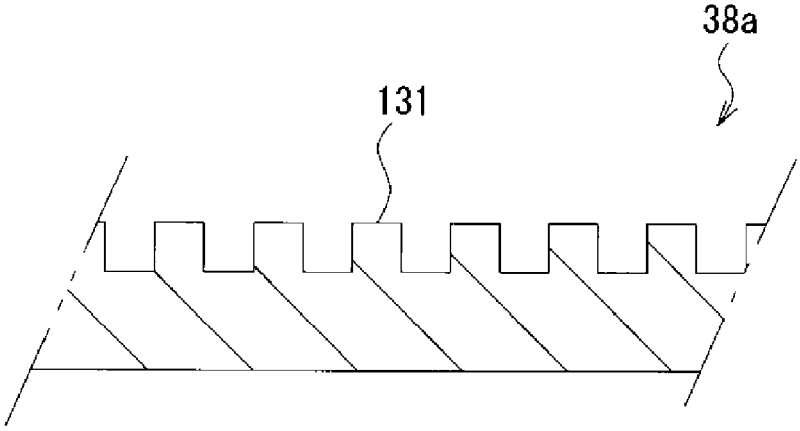
FIG. 8C is a sectional view of FIG. 8B.
Figure 9:
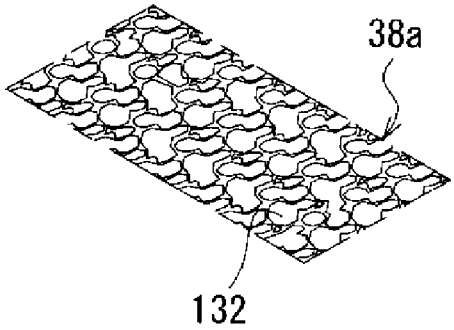
FIG. 9 is a partial plan view of another alternative shutter plate.

In an alternative process of enhancing the surface roughness of the upper surfaces of the first compartmenting parts 38 of the upper shutter plate 34 and the lower shutter plate 35, as shown in FIGS. 8A to 8C, a plurality of cuboid protrusions 131 may be provided in a matrix shape in a predetermined section 38*a* of the upper surface of the first partitioning portion 38 to form regular concavo-convex portions. In another alternative process, as shown in FIG. 9, said section 38*a* may be formed with irregular concavo-convex portions by etching.

Referring to FIGS. 3A to 3C, 6 and 10A to 10C, the tablet dispensing member 36 is reciprocated in the column direction in the arrangement of the tablet receiving measures 21 by means of a drive device including a rack and pinion mechanism and a motor. The tablet dispensing member 36 is provided with a total of twenty-eight tablet dispensing measures 42 defined in four rows and seven columns, which correspond to the tablet receiving measures 21 of the tablet receiving part 22. The tablet dispensing measure 42 is opened at both its upper and lower ends. A bottom plate 43, which is openable and closable, is disposed at a lower opening of each of the tablet dispensing measures 42.

Figure 11:
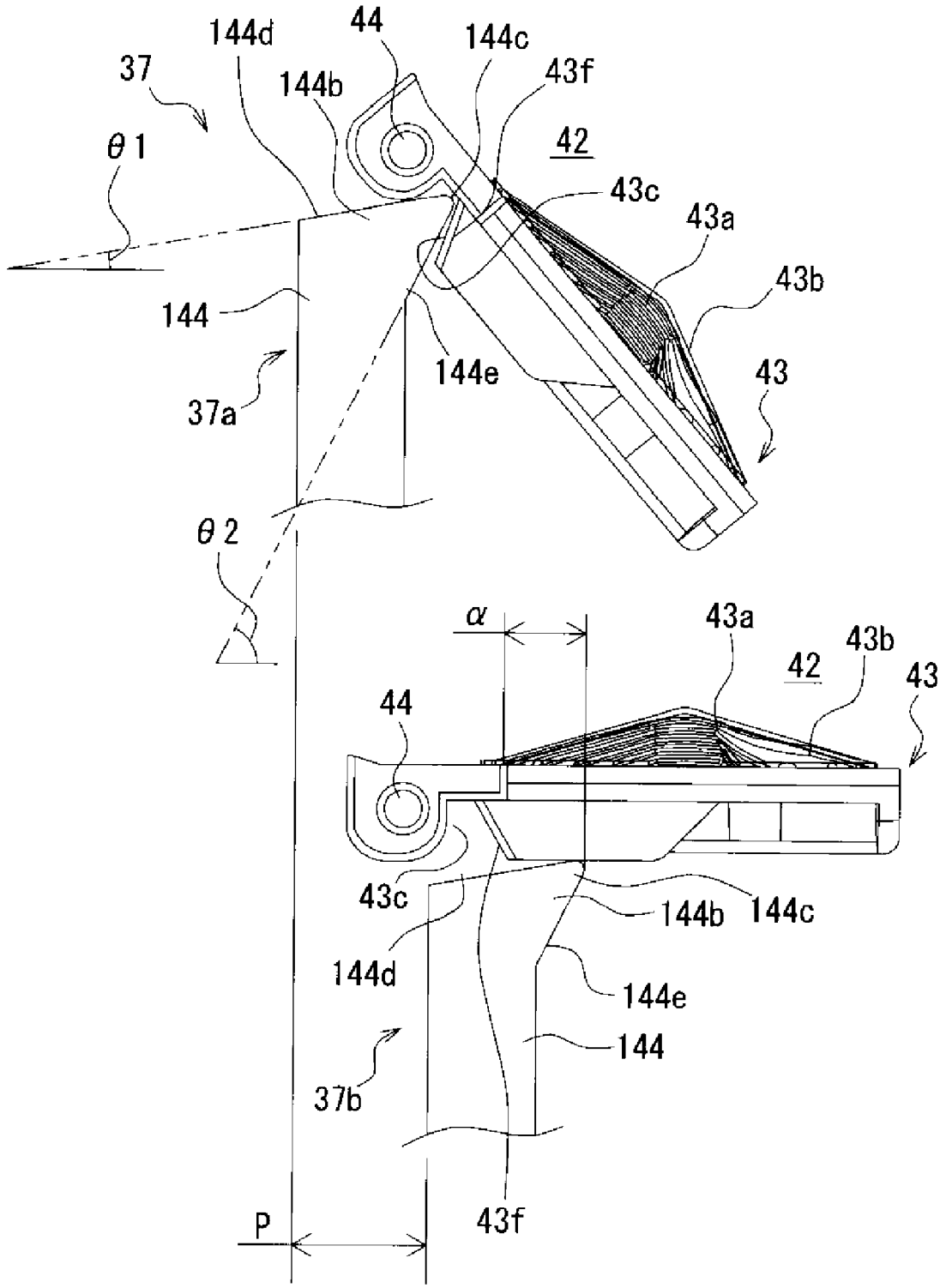
FIG. 11 is a schematic view showing a relationship between a bottom plate and an opening protrusion.
Figure 12A:
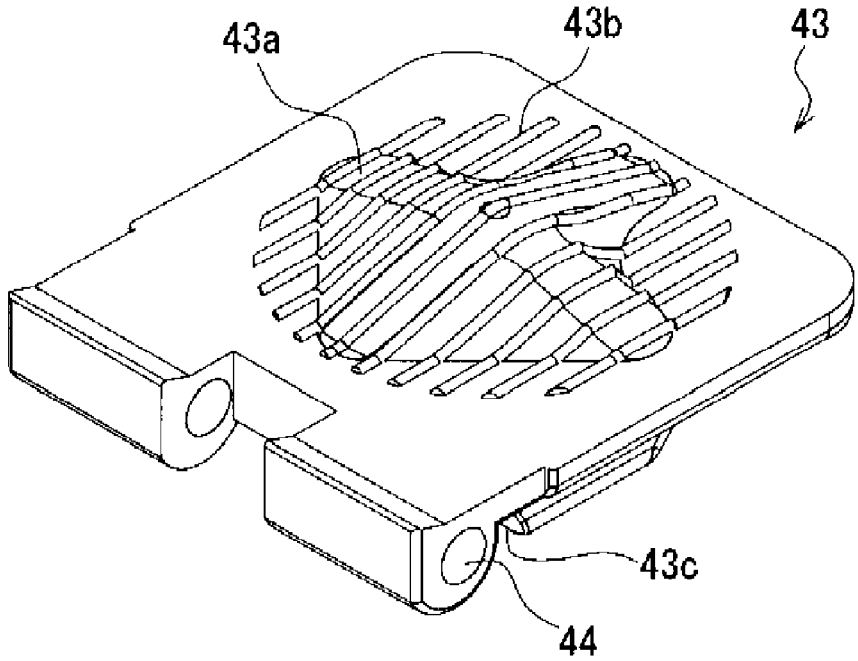
FIG. 12A is a perspective view of a bottom plate.
Figure 12B:
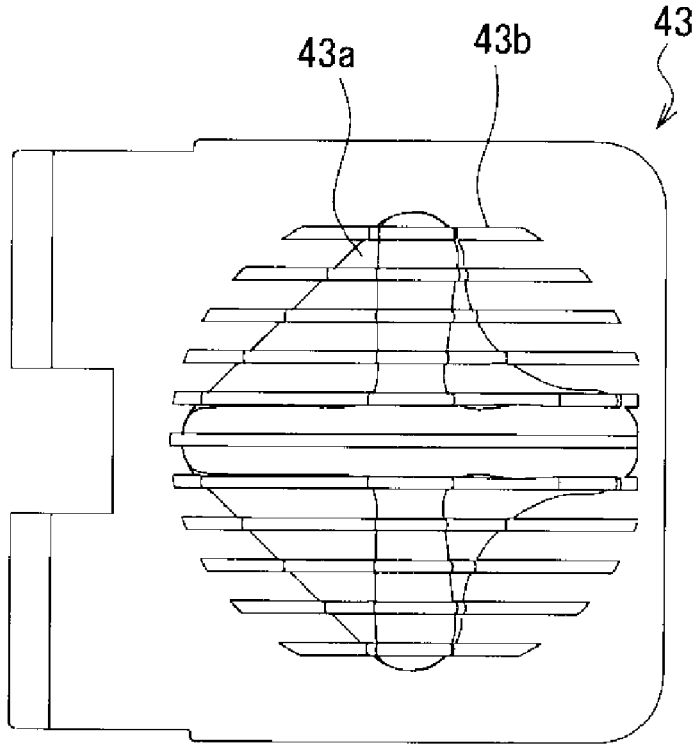
FIG. 12B is a plan view of the bottom plate.
Figure 12C:
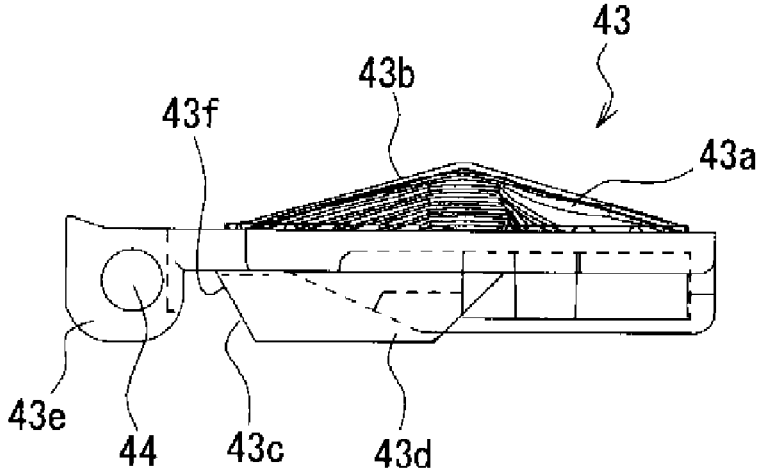
FIG. 12C is a side view of the bottom plate.
Figure 12D:
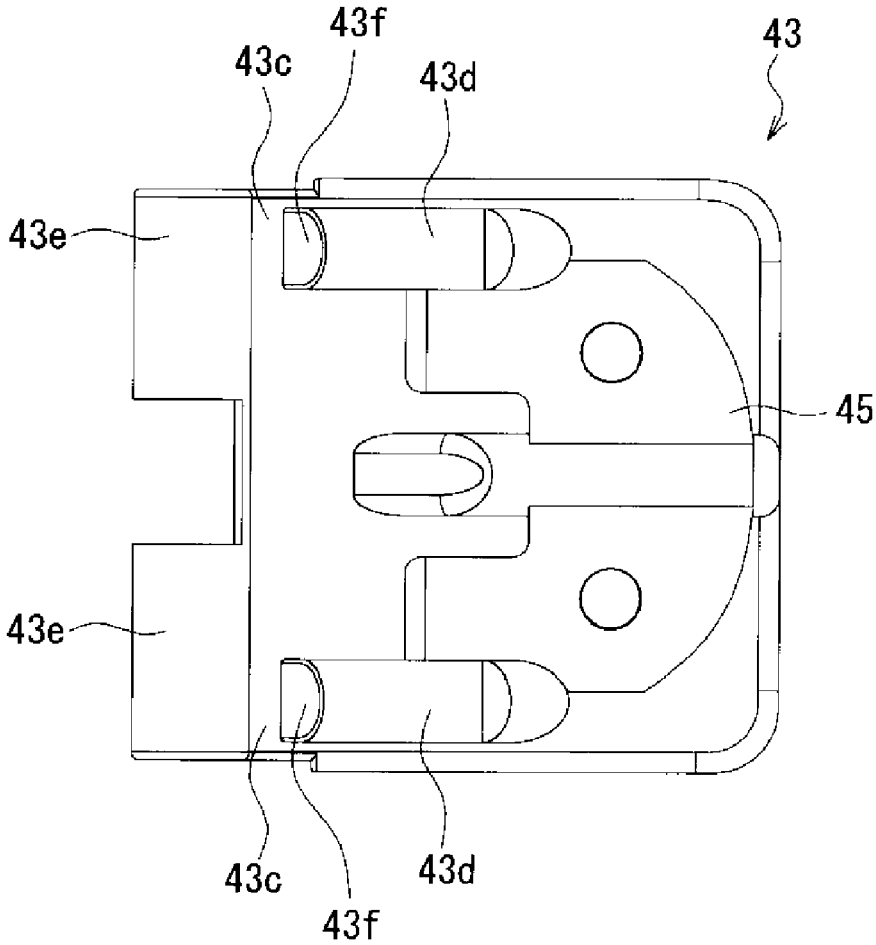
FIG. 12D is a bottom view of the bottom plate.
Figure 12E:
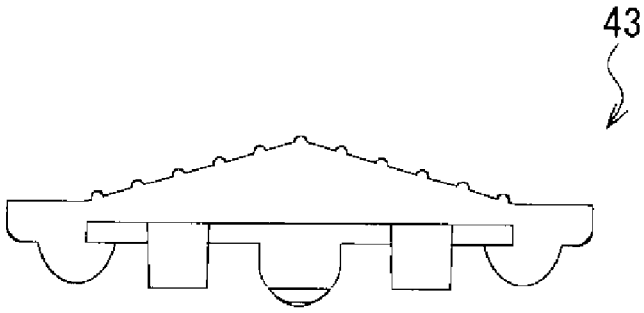
FIG. 12E is a front view of the bottom plate.
Figure 12F:
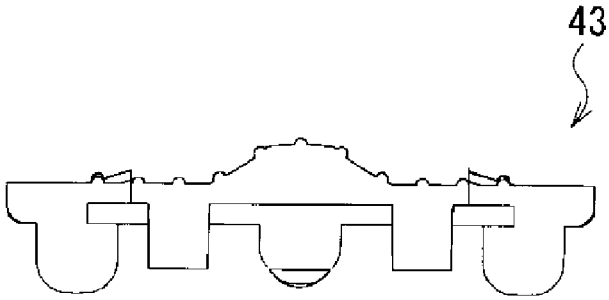
FIG. 12F is a rear view of bottom plate.

Referring to FIGS. 11 to 12F, the bottom plate 43 provided in the lower opening of each of the tablet dispensing measures 42 is pivotally supported with respect to the tablet dispensing member 36 at its base end through a pin 44 (shaft part). Specifically, the base end of the bottom plate 43 is provided with a pair of bearing portions 43*e* of a cylindrical shape, through which the pin 44 passes. Further, an opening weight 45 is attached to a lower surface of the bottom plate 43. A leading end of the bottom plate 43 is a free end. The bottom plate 43 is pivotal about the pin 44 between a closed position wherein the bottom plate closes the lower opening of the tablet dispensing measure 42 to hold tablets in the tablet dispensing measure 42 (bottom plate 43*a* in FIG. 11) and an open position wherein the bottom plate opens the lower opening of the tablet dispensing measure 42 to drop tablets in the tablet dispensing measure 42 to the packing unit 4.

As shown in FIGS. 12A to 12C, the upper surface of the bottom plate 43, which holds the tablets in the closed position, is provided with a swelled portion 43*a*, which is swelled upward in a central portion for enhancing surface roughness. Further, the upper surface of the bottom plate is provided with a plurality of rib portions 43*b* formed on the swelled portion 43*a*. Providing the swelled portion 43*a* and the rib portion 43*b* can prevent the tablets from adhering on the upper surface of the bottom plate 43 due to a static electricity. Regarding such an anti-adhesion, it is believed that the tablets are in contact with a top end of the swelled portion 43*a*, thereby decreasing a contact area between the tablets and the bottom plate 43. Further, it is believed that small gaps are formed between the tablets and the bottom plate 43 due to decrease in the contact area and a corona discharge is caused in such a small gap.

Figure 13:
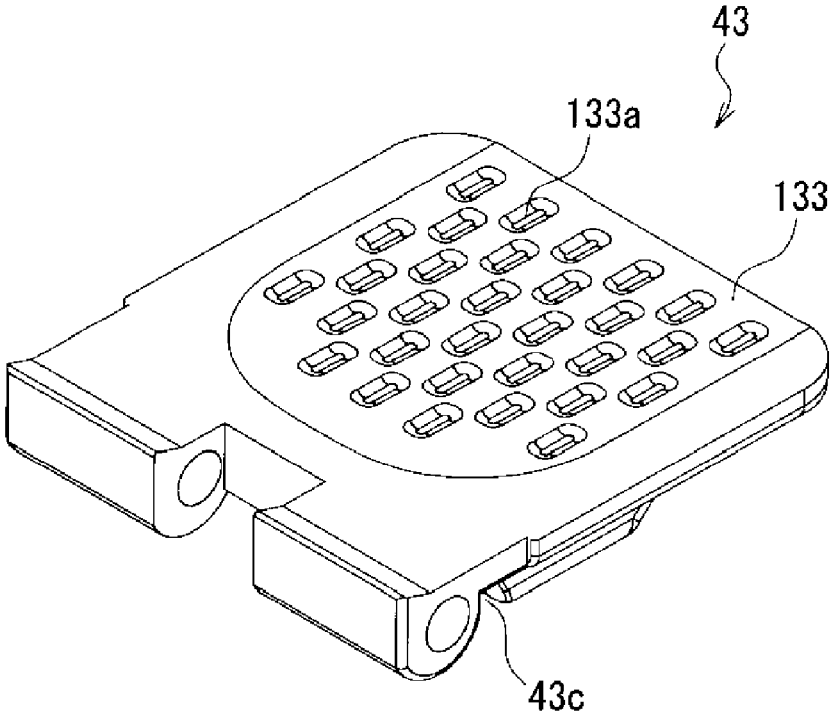
FIG. 13 is a perspective view of an alternative bottom plate.
Figure 14:
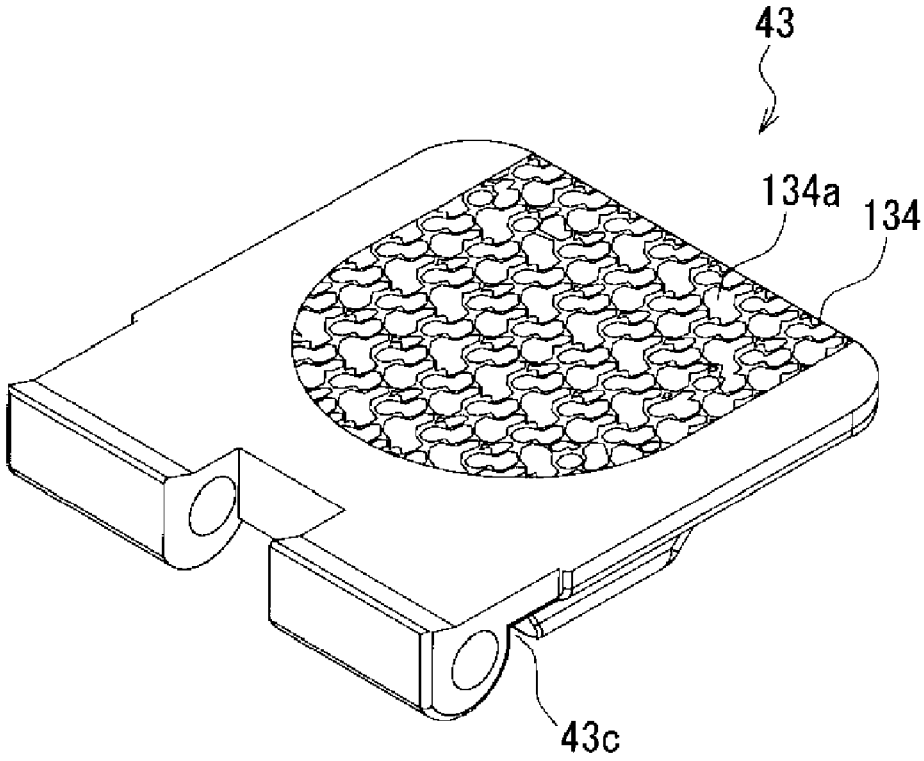
FIG. 14 is a perspective view of another alternative bottom plate.

In an alternative process of enhancing the surface roughness of the upper surface of the bottom plate 43, as shown in FIG. 13, a plate body 133, which is provided with a plurality of swelled portions 133*a* of a half-elliptical sphere shape formed by embossing several times, may be attached to the upper surface of the bottom plate 43. Further, as shown in FIG. 14, a plate body 134 provided with irregular concavo-convex portions 134*a* formed by etching may be attached to the upper surface of the bottom plate 43.

The lower surface of the bottom plate 43 is provided with an opening recess 43*c*, which is positioned near the pin 44 from a halfway position between the pin 44 (base end) and the free end (leading end). Specifically, the lower surface of the bottom plate 43 is provided with a pair of rib portions 43*d*, 43*d*. The opening recess 43*c* is defined by one end of the rib portions 43*d*, 43*d* (an end adjacent to the base end of the bottom plate 43), the lower surface of the bottom plate 43 and the bearing portion 43*e*.

Figure 6:
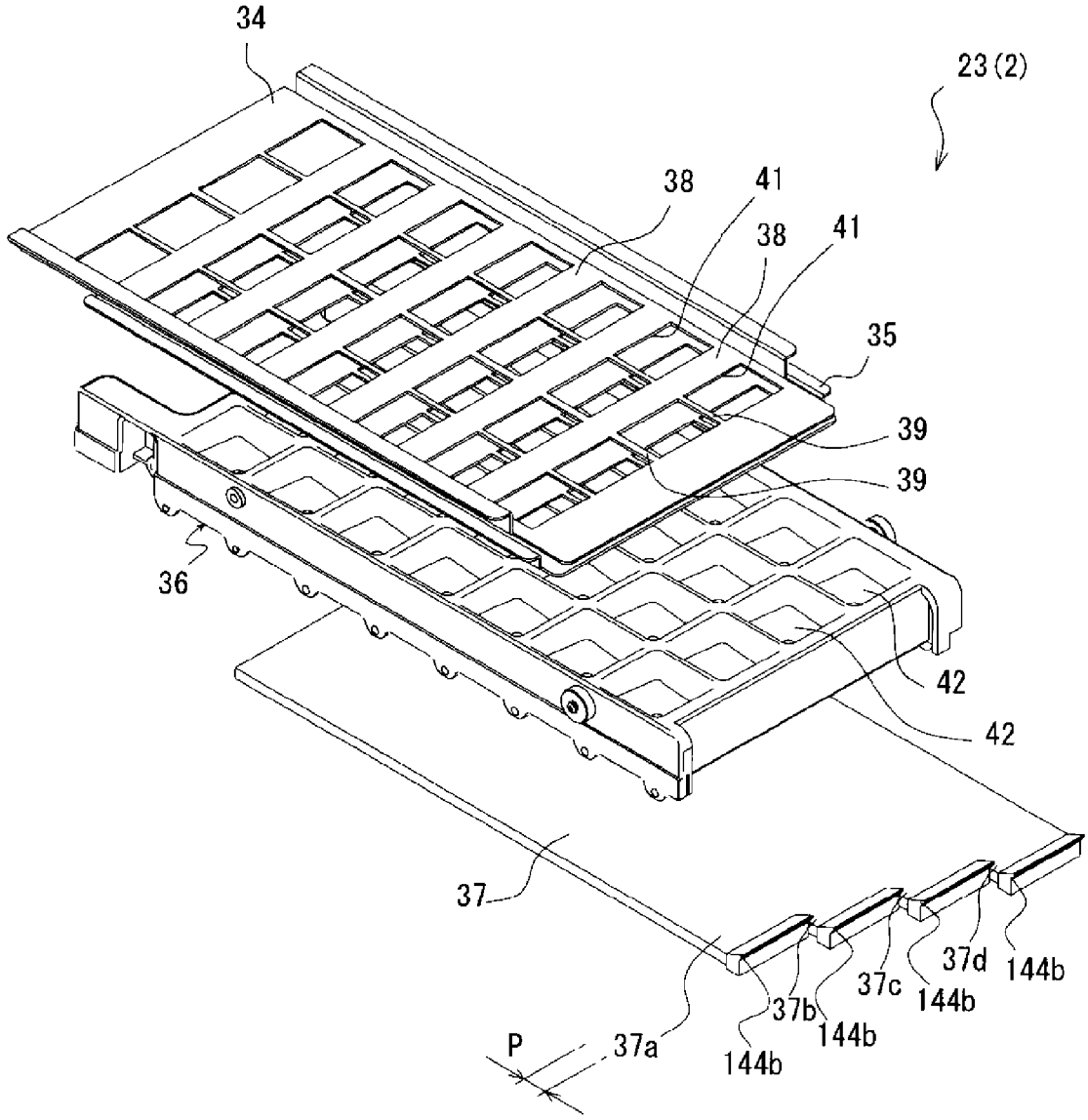
FIG. 6 is an exploded perspective view showing a tablet dispensing part.

The bottom plate 43 of the medicine dispensing measure 42 is placed on an upper surface of the fixed plate 37, thereby maintaining the bottom plate 43 in the closed position. Referring to FIG. 6, a right edge of the fixed plate 37 (an edge at a right side in FIG. 6) is provided with stepped portions 37*a* to 37*d* as many as the rows of the tablet receiving measures 21 and the tablet dispensing measures 42 (in the present embodiment, four rows). Pitches P between the neighboring stepped portions 37*a* to 37*d* (distances in the column direction between the stepped portions 37*a* to 37*d* neighboring in the row direction) correspond to a value obtained by dividing a pitch in the column direction of the tablet receiving measures 21 and the tablet dispensing measures 42 by the number of the rows of the tablet receiving measures 21 and the tablet dispensing measures 42.

Figure 10A:
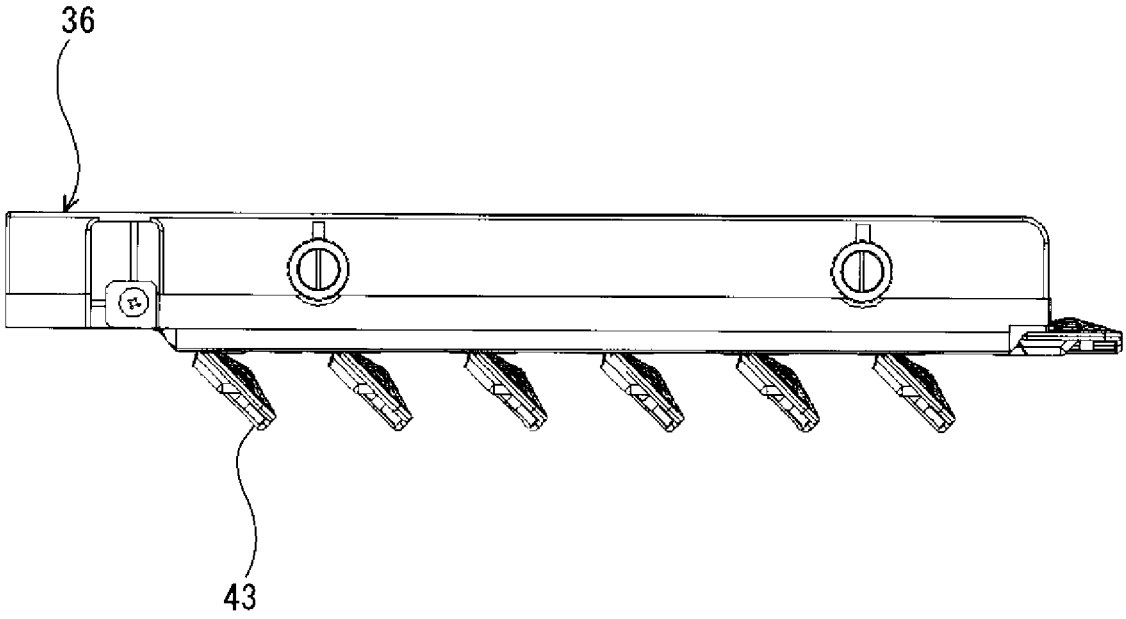
FIG. 10A is a side view of a tablet dispensing member.
Figure 10B:
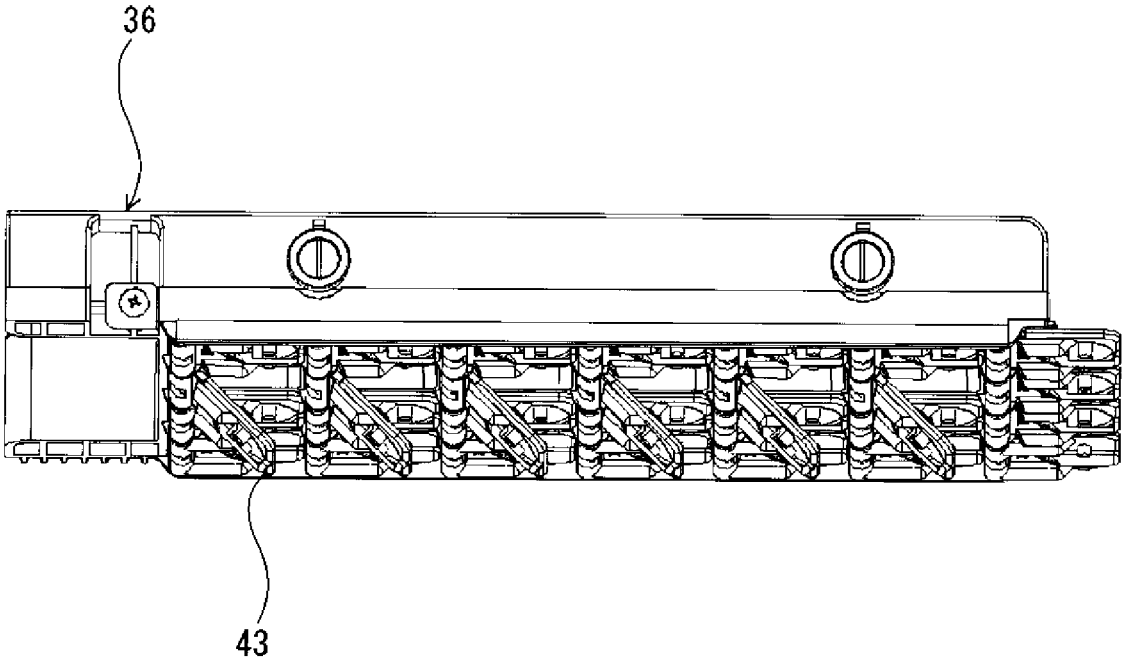
FIG. 10B is a lower perspective view of the tablet dispensing member.
Figure 10C:
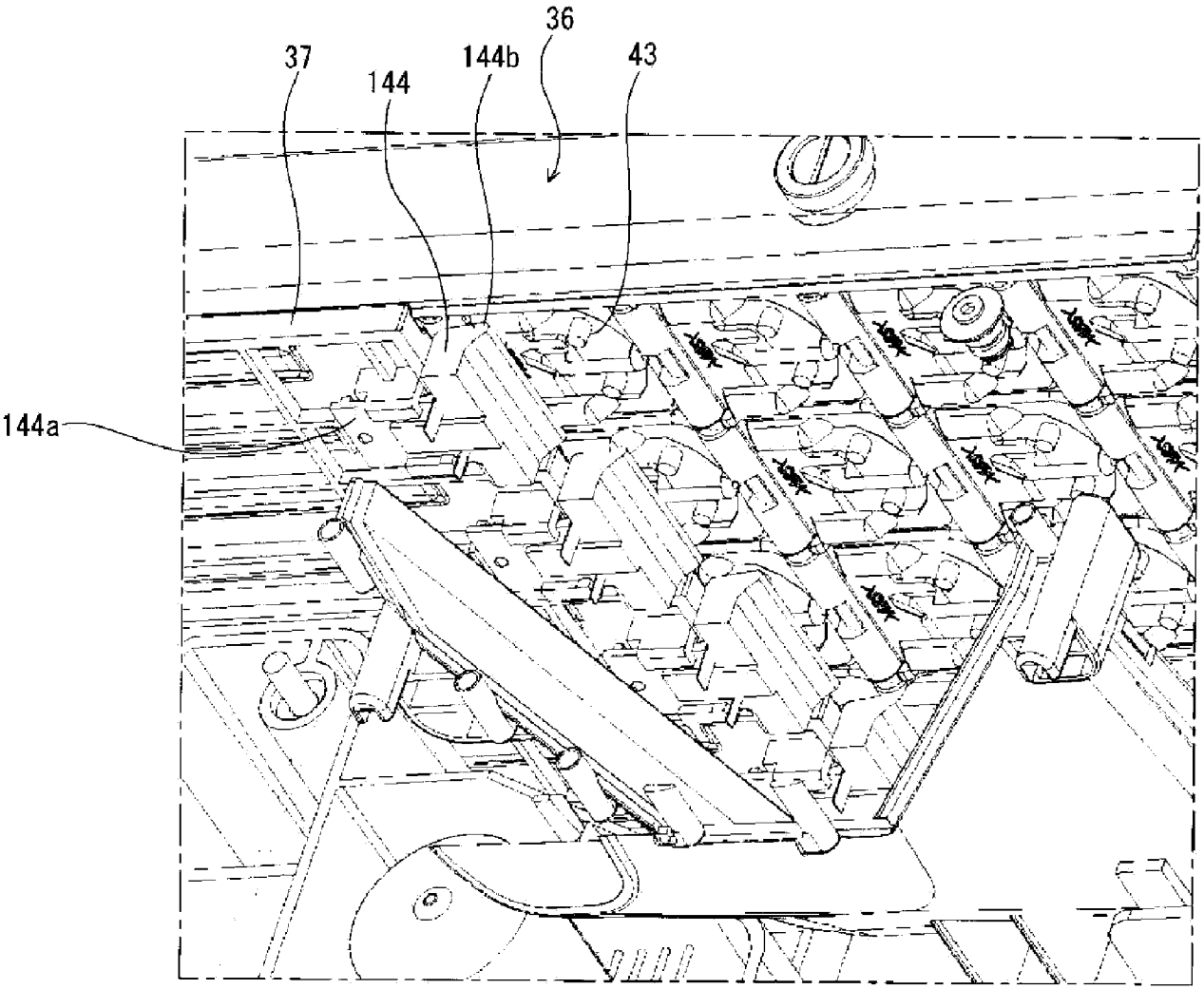
FIG. 10C is an enlarged lower perspective view of the tablet dispensing member.
Figure 15A:
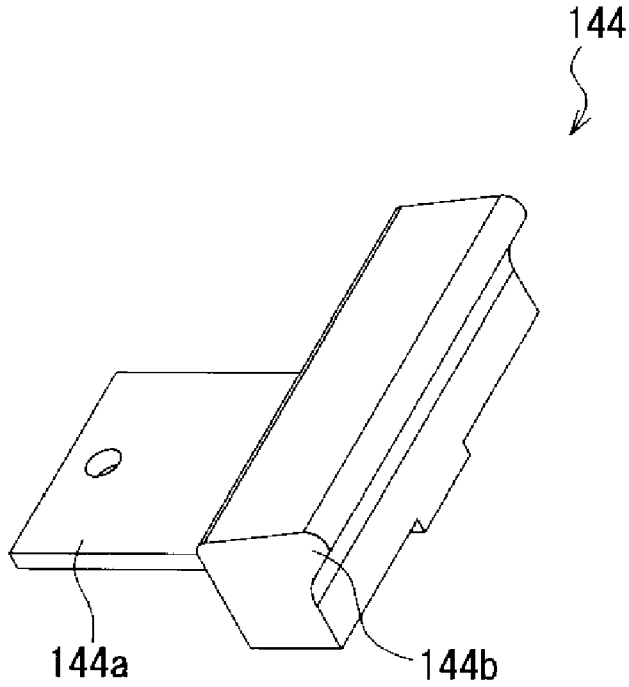
FIG. 15A is a perspective view of an opening protrusion.
Figure 15B:
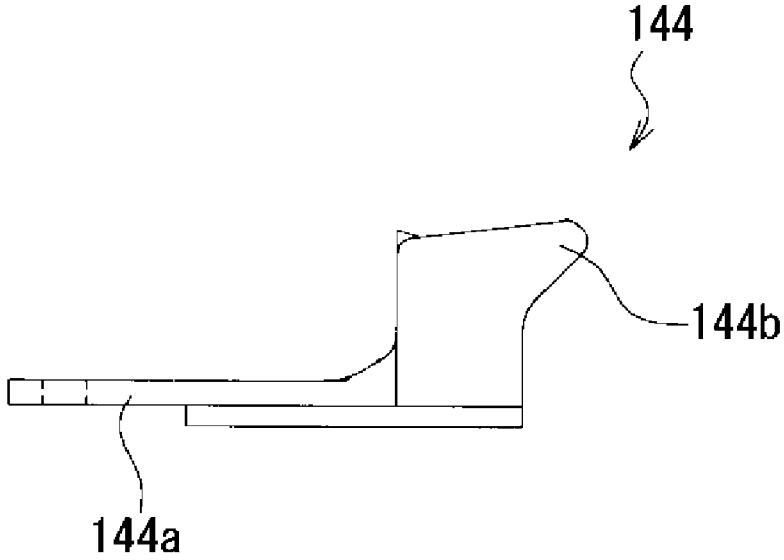
FIG. 15B is a side view of the opening protrusion.
Figure 15C:
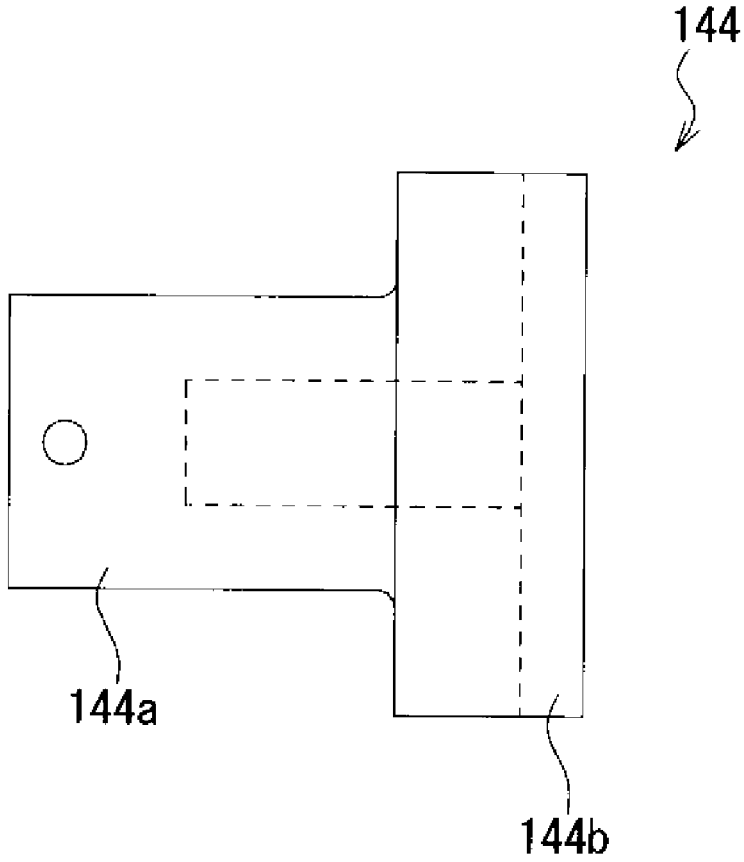
FIG. 15C is a plan view of the opening protrusion.

Referring to FIGS. 10B and 10C, each of the stepped portions 37*a* to 37*d* is provided with an opening member 144. Referring to FIGS. 15A to 15C, the opening member 144 includes an attachment portion 144*a* for attaching to lower surfaces of the stepped portions 37*a* to 37*d* of the fixed plate 37 at its base end. Further, the opening member includes an opening protrusion 144*b* protruding upward. The opening protrusion may be integrally formed in the stepped portions 37*a* to 37*d* of the fixed plate 37. Referring to FIG. 11, the opening protrusion 144*b* includes the following: an upper surface 144*d* extending downwardly from a leading end 144*c* at an angle θ1 with respect to a horizontal direction (in the present embodiment, the angle θ1 is 7.8° and preferably 0°~10°); and a lower surface 144*e* extending from the leading end 144*c* at an angle θ2 greater than the angle θ1 with respect to the horizontal direction (in the present embodiment, the angle θ2 is 45° and preferably 0°~90°).

Referring to the bottom plate 43 shown in an upper part of FIG. 11, a wall surface 43*f* located at a leading side (toward the free end of the bottom plate 43) of the opening recess 43*c* of the bottom plate 43 is formed as an inclined surface having an angle at which it is in surface contact with the lower surface 144*e* of the opening protrusion 144*b* when the bottom plate 43 is opened.

The tablet dispensing member 36 moves with respect to the fixed plate 37 in the column direction in the arrangement of the tablet dispensing measure 42. The leading end 43*c* of the opening protrusion 144*b* protruding upwardly in the stepped portions 37*a* to 37*d* supports the lower surface of the bottom plate 43. However, if the tablet dispensing measures 42 reach the corresponding stepped portions 37*a* to 37*d*, then the opening protrusion 144*b* in the stepped portions 37*a* to 37*d* is disengagably fitted to the opening recess 43*c* of the lower surface of the bottom plate 43. Thus, the bottom plate 43 is pivoted to the open position to thereby allow the lower opening of the tablet dispensing measure 42 to be opened. (see the bottom plate 43 shown at an upper part of FIG. 11) With such a configuration, once the opening recess 43*c* of the bottom plate 43 reaches the opening protrusion 144*b* by the movement of the tablet dispensing member 36, the leading end 144*c* of the opening protrusion 144*b* is immediately fitted to the opening recess 43*c*. Thus, the bottom plate 43 pivots about the pin 44 from the closed position to the open position due to its own weight. In other words, the bottom plate 43 does not pivot slowly from the closed position to the open position, but rather pivots rapidly and completely due to its own weight from the closed position to the open position when it reaches a predetermined position. That is, a behavior or position of the bottom plate 43 generally includes only two positions consisting of closed and open positions and substantially does not include an intermediate state (e.g., a tilting state or a half-opened state). Thus, the bottom plate 43 does not produce a downward displacement (tilting) due to its own weight at its free end of the bottom plate 43 before it reaches the leading end of the stepped portions 37*a* to 37*d*. Accordingly, it is possible to prevent the tablets from unintentionally dropping from a gap formed in the lower end of the tablet dispensing measure 42 and further prevent a failure in packing resulting therefrom.

Further, since the opening protrusion 144*b* is fitted to the opening recess 43*c* of the bottom plate 43, the tablet dispensing member 36 is situated with high precision. Thus, a distance α between the opening recess 43*c* and the opening protrusion 144*b* can be set narrowly with respect to the bottom plate 43 neighboring one of the bottom plates 43 being in the open position (e.g., the bottom plate 43 shown at a lower part of FIG. 11), i.e., with respect to the bottom plate 43 next pivoting from the closed position to the open position. Further, since the distance α can be set narrowly, the pitches P between the stepped portions 37*a* to 37*d* of the fixed plate 37 can be narrowed as well. Accordingly, it is possible to shorten a movement distance of the tablet dispensing member 36 required to open all the bottom plates 43 and to achieve compactness of the device (a dimension reduction in the column direction in the arrangement of the tablet receiving measures 21 and the tablet dispensing measures 42).

Furthermore, since the tablet dispensing member 136 is situated with high precision by fitting the opening protrusion 144*b* to the opening recess 43*c* of the bottom plate 43, it is possible to move the tablet dispensing member 36 at a high speed and to enhance a speed for dispensing tablets from the tablet dispensing part 23 to the packing unit 4 to accomplish high-speed packing.

(Powdered Medicine Feeding Unit) Powdered medicine is manually fed to the powdered medicine feeding unit 3. The powdered medicine feeding unit automatically divides such a powdered medicine into each one pack and sequentially feeds the same to the packing unit 4.

Referring to FIG. 1, the powdered medicine feeding unit 3 includes a narrow and elongated measure (a V-shaped measure 51), which is opened in the upper surface of the housing 6 and has an approximately V-shaped cross section. A bottom portion of the V-shaped measure 51 is openable and closable. Further, multiple dividing containers (not shown) are disposed below the V-shaped measure 51. As the bottom portion is opened, the powdered medicine put into the V-shaped measure 51 drops to the dividing container to be divided at a predetermined amount. A bottom portion of the dividing container is also openable and closable. As the bottom portions of the dividing containers are sequentially opened, the powdered medicine in each of the dividing containers drops to a hopper 67 and is then fed to the packing unit 4 by one pack at a time. Further, a movable partition plate 52 for adjusting a division number of the powdered medicine is disposed in the V-shaped measure 51.

The configuration of the powdered medicine feeding unit 3 is not limited particularly as far as the powdered medicine is fed to the packing unit 4 by one pack at a time. For example, the powdered medicine feeding unit 3 may feed the powdered medicine put into the hopper to a ring-shaped peripheral groove of a distributing tray and then sequentially feed the powdered medicine for one pack raked from the ring-shaped peripheral groove by a raking device to the packing unit 4.

Figure 16:
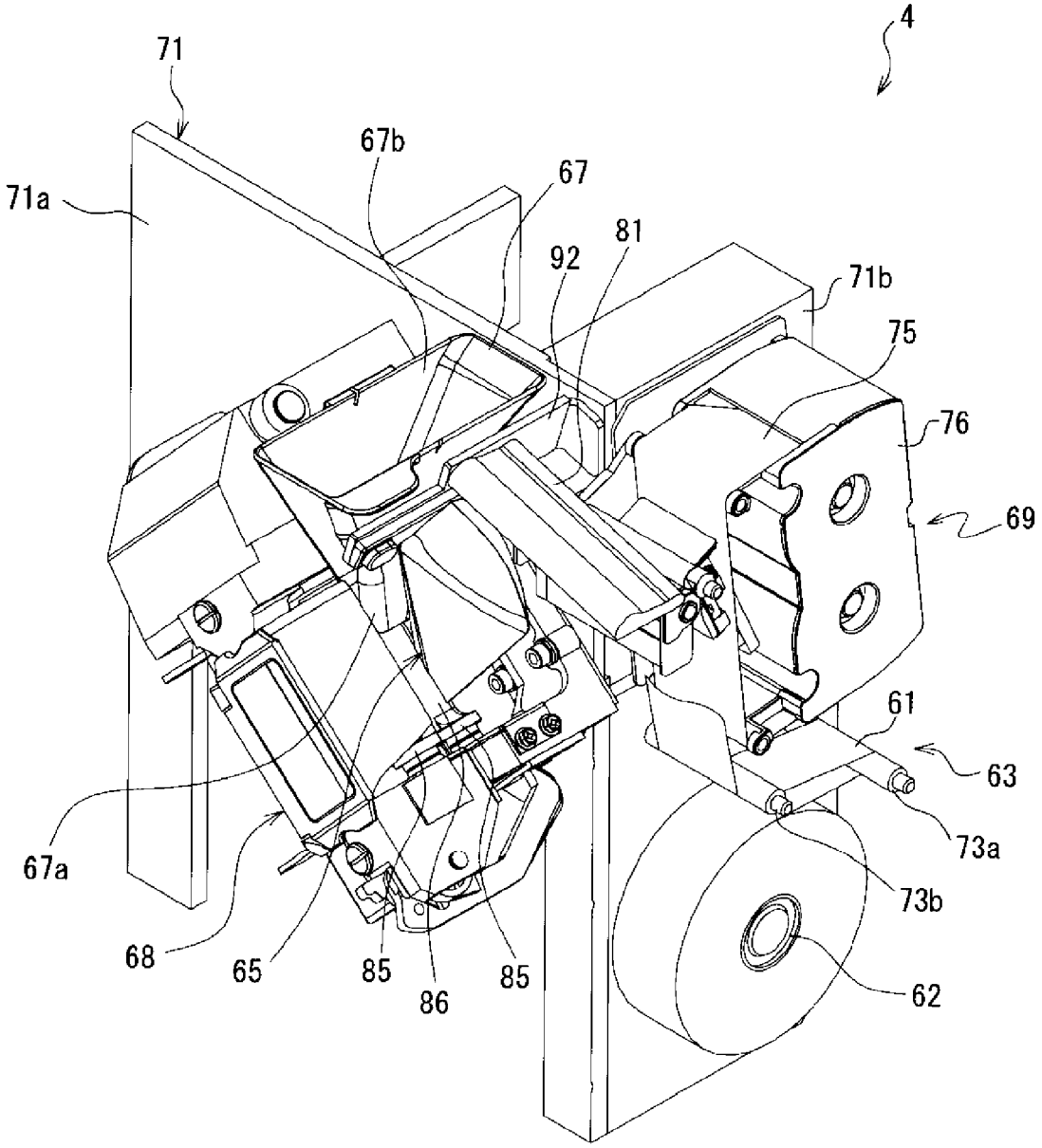
FIG. 16 is a perspective view of a packing unit.
Figure 17:
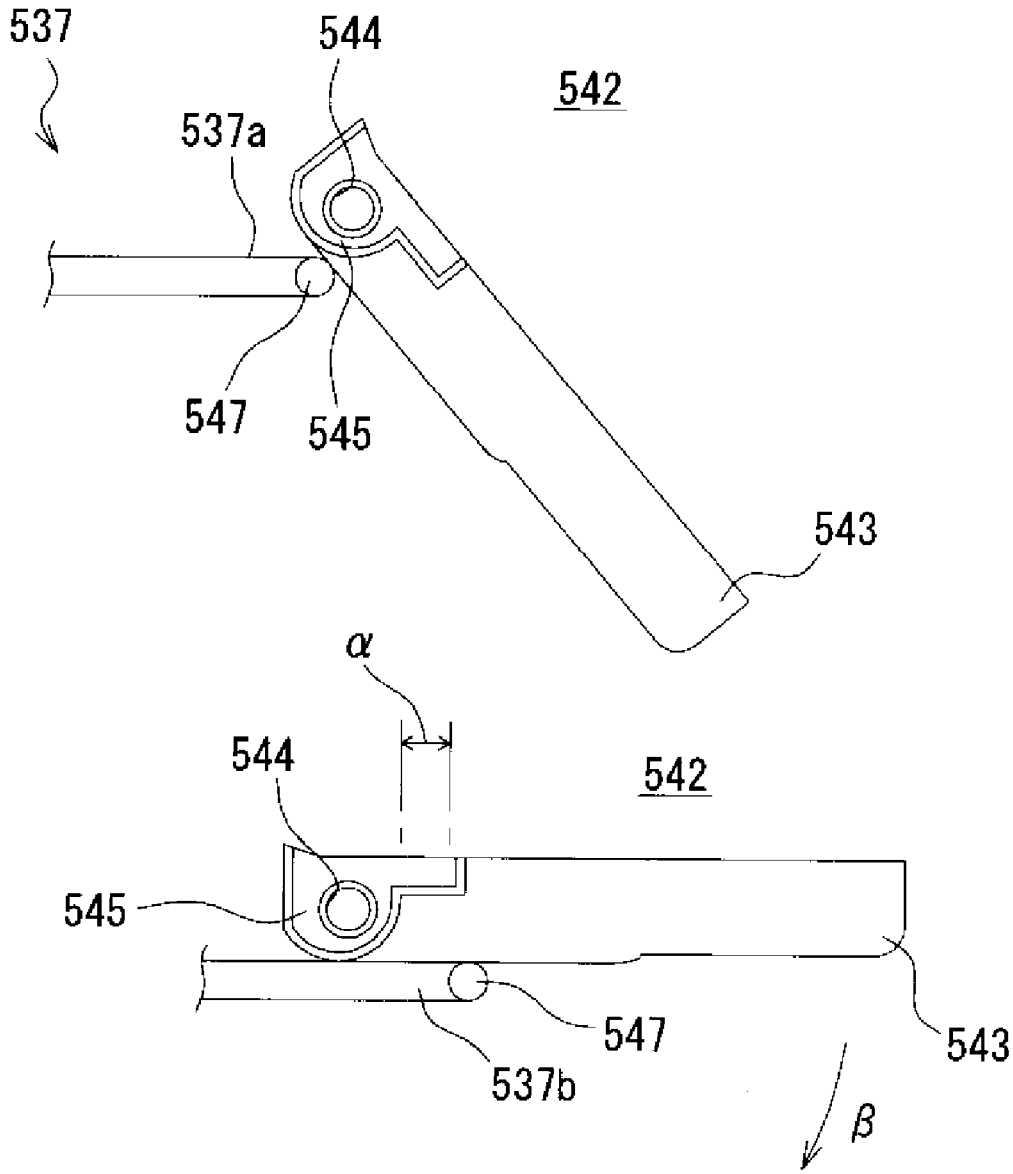
FIG. 17 is a schematic view showing a relationship between a bottom plate and a fixed plate in a prior art medicine packing device.

(Packing unit) Referring to FIG. 16, the packing unit 4 includes a sheet feeding part 63, an unfolding guide 65, a hopper 67, a heat-sealing part 68 and a printing part 69 on a holding frame 71 housed in the housing 6. The sheet feeding part 63 unwinds and feeds a narrow and elongated packing sheet 61 from a roll 62. The packing sheet 61 is bifold along its length direction in advance and is wound around the roll. The unfolding guide 65 unfolds and opens the bifold packing sheet 61, which is fed by the sheet feeding part 63. The hopper 67 includes an input opening 67*b* at its upper end and a nozzle portion 67*a* at its lower end. Medicines are inputted from the tablet feeding unit 2 and the powdered medicine feeding unit 3 to the input opening. The nozzle portion 67*a* serves as an introducing opening through which the medicine is introduced to the opening of the bifold packing sheet 61. The heat-sealing part 68 seals the packing sheet 61 to put the introduced medicine therein, thereby making a consecutive medicine pack. The printing part 69 is disposed between the sheet feeding part 63 and the unfolding guide 65 on a path of the packing sheet 61 and prints information such as a patient's name, a medicine name and a usage on the packing sheet 61.

Next, operations of the medicine packing device 1 will be described below. Tablets are manually put through the upper opening 21*a* and received by each of the tablet receiving measures 21. Thereafter, if a start button in the control panel 9 is selected, then the tablet dispensing part 23 operates. Subsequently, the tablets fed from the tablet receiving part 22 are transferred one pack at a time to the hopper 67 of the packing unit 4 through a transfer path (not shown). Then, a packing process is conducted in the packing unit 4.

First, before the start button is selected (i.e., in a non-operating state), the tablet dispensing part 23 is in a state shown in FIG. 3A. That is, the upper and lower shutter plates 34, 35 are in the closed position where the lower opening 21*b* of each of the tablet receiving measures 21 is closed by the first partitioning portion 38 of the upper shutter plate 24 and the first partitioning portion 38 of the lower shutter plate 35. If the start button is selected, then the tablet dispensing member 36 moves leftward (in the column direction) in the figures. If one end of the tablet dispensing member 36 engages the engaging portion 35*a* of the lower shutter plate 35, then the lower shutter plate 35 also moves leftward together with the tablet dispensing member 36. If the tablet dispensing member 36 further moves leftward in the figures, then the one end of the tablet dispensing member 36 engages the engaging portion 34*a* of the upper shutter plate 34 via the engaging portion 35*a* of the lower shutter plate 35. As a result, the upper shutter plate 34 also moves leftward together with the tablet dispensing member 36.

As the upper and lower shutter plates 34, 35 move together with the tablet dispensing member 36, the tablet dispensing part 23 goes into a state shown in FIG. 3C. That is, the upper and lower shutter plates 34, 35 proceed into the open position where the first partitioning portion 38 of the upper shutter plate 34 retracts beneath the first barrier wall 24*a* of the tablet receiving part 22, where the first partitioning portion 38 of the lower shutter plate 35 retracts beneath the first partitioning portion 38 of the upper shutter plate 34, and where the tablet passing apertures 41, 42 of the upper and lower shutter plates 34, 35 are opposed to the respective lower openings 21*b* of the tablet receiving measures 21. Further, when the upper and lower shutter plates 34, 35 are in the open position, the upper openings of the tablet dispensing measure 42 of the tablet dispensing member 36 are opposed to the respective lower openings 21*b*. Thus, the tablets for one pack received in each of the tablet receiving measures 21 are received in the tablet dispensing measure 42 of the tablet dispensing member 36 through the lower opening 21*b* and the tablet passing aperture 41, 41. Since the upper surfaces of the upper and lower shutter plates 34, 35 are processed for enhancing surface roughness as described above, the tablets surely drop from the tablet receiving measure 21 to the medicine dispensing measure 42 without adhering on the upper and lower shutter plates 34, 35 due to a static electricity.

Subsequently, if the tablet dispensing member 36 moves rightward in the figures, then the bottom plate 43 of the tablet dispensing measure 42 reaches the stepped portions 37*a* to 37*d* from a foremost one in its movement direction one after another. When the opening protrusion 144*b* is fitted to the opening recess 43*c*, the bottom plate 43 pivots from the closed position to the open position. Thus, the tablets in each of the tablet dispensing measures 42 drop and are fed to the hopper 67. Since the bottom plate 43 is allowed to open when the opening protrusion 144*b* is fitted to the opening recess 43*c*, the bottom plates 43 are surely maintained in the closed position until they reach the corresponding stepped portions 37*a* to 37*d*. Thus, the tablets do not drop unintentionally from the tablet dispensing measure 42. Further, as described above, since the upper surface of the bottom plate 43 is processed for enhancing surface roughness, the tablets do not adhere on the bottom plate 43 due to a static electricity and drop from the tablet dispensing measure 42 without fail when the bottom plate 43 pivots to the open position. The tablets, which are dropped from the tablet dispensing measure 42 to the hopper 67, are packed one pack at a time in the packing unit 4.

After the tablet dispensing member 36 moves up to a right movement limit in FIGS. 3A to 3C and all the bottom plates 43 of the tablet dispensing measures 42 are opened (i.e., after the tablets in all the tablet dispensing measures 42 are dispensed to the packing unit 4), the tablet dispensing member 36 moves leftward in FIGS. 3A to 3C (i.e., a return movement). Due to the return movement of the tablet dispensing member 36, the bottom plate 43 pivots about the pin 44 from the open position where the opening protrusion 144*b* is fitted to the opening recess 43*c* similar to the bottom plate 43 shown in an upper part of FIG. 11. Thereafter, like the bottom plate 43 shown in a lower part of FIG. 11, the bottom plate 43 goes into the open position where its lower surface is supported by the leading end 144*c* of the opening protrusion 144*b* pulled out from the opening recess 43*c*. As described above, the wall surface 43*f* located at the leading side of the opening recess 43*c* is the inclined surface, which is placed in surface contact with the lower surface 144*e* of the opening protrusion 144*b* when the bottom plate 43 is opened. Thus, when the tablet dispensing member 36 performs the return movement (a leftward movement in FIGS. 3A to 3C and 11), the lower surface of the opening recess 43*c* of the bottom plate 43 can be smoothly and certainly pushed up by the lower surface 144*e* and the leading end 144*c* of the opening protrusion 144*b*. Accordingly, each of the bottom plates 43 rapidly and certainly returns to the closed position one after another along with the return movement of the tablet dispensing member 36. As such, a combination of the opening recess 43*c* and the opening protrusion 144*b* in the present embodiment ensures not only that the bottom plate 43 rapidly pivots from the closed position to the open position, but also that the bottom plate 43 promptly and certainly pivots from the open position to the closed position after dispensing the tablets.

The invention claimed is:

1. A medicine packing device, comprising:

a tablet receiving part including a plurality of tablet receiving measures defined in a plurality of rows in forward and backward directions and in a plurality of columns in a transverse direction, each of the tablet receiving measures receiving tablets for one pack;

a tablet dispensing part for removing tablets from a lower opening of the tablet receiving measure and dispensing the removed tablets one pack at a time; and a packing part for packing the tablets dispensed by the tablet dispensing part one pack at a time, wherein the tablet dispensing part comprises:

an opening and closing mechanism disposed below the tablet receiving part to open and close the lower opening of the tablet receiving measure;

a tablet dispensing member disposed below the opening and closing mechanism and including a plurality of tablet dispensing measures defined in a plurality of rows and in a plurality of columns to correspond to the tablet receiving measures, each of the dispensing measures receiving the tablets dropped from the lower opening of the tablet receiving measure opened by the opening and closing mechanism, the tablet dispensing member being movable in a column direction of the tablet dispensing measures;

bottom plates provided at a lower opening of each of the tablet dispensing measures, the bottom plate including: a shaft part rotatably connected to the tablet dispensing member at a base end thereof, a leading end thereof being a free end; and an opening recess located on a lower surface near the rotating shaft from a halfway point between the rotating shaft and the free end, the bottom plate being pivotable about the shaft part between a closed position where the bottom place closes the lower opening of the tablet dispensing measure to hold the tablets in the tablet dispensing measure and an open position where the tablets are dropped to the packing part by opening the lower opening of the tablet dispensing measure;

a fixed plate disposed below the tablet dispensing member, the fixed plate including: stepped portions at one leading end in the column direction of the medicine dispensing measures; and an opening protrusion disengagably fitted to the opening recess of the bottom plate, each of the stepped portions supporting the lower surface of the bottom plate to maintain the bottom plate in the closed position; and a drive device for moving the tablet dispensing member in the column direction of the tablet dispensing measure, wherein when the tablet dispensing measure reaches the corresponding stepped portion by a movement of the tablet dispensing member caused by the drive device, the opening protrusion of the fixed plate is fitted to the opening recess of the bottom plate and thus bottom plate pivots about the shaft part from the closed position to the open position.

2. The medicine packing device of claim 1, wherein the opening protrusion includes:

an upper surface extending downwardly from a leading end of the opening protrusion at a first angle with respect to a horizontal direction; and a lower surface extending downwardly from the leading end at a second angle greater than the first angle with respect to the horizontal direction.

3. The medicine packing device of claim 2, wherein an upper surface of the bottom plate is processed for enhancing a surface roughness.

4. The medicine packing device of claim 3, wherein the opening and closing mechanism includes a pair of shutters formed with a plurality of tablet passing apertures corresponding to the tablet receiving measures, the shutters moving to a closed position where upper surfaces thereof form bottom portions of the tablet receiving measures and to an open position where the tablet passing apertures communicate with the tablet receiving measures to open the lower openings of the tablet receiving measures, and wherein upper surfaces of closing portions of the shutters are processed for enhancing a surface roughness.

5. The medicine packing device of claim 2, wherein the opening and closing mechanism includes a pair of shutters formed with a plurality of tablet passing apertures corresponding to the tablet receiving measures, the shutters moving to a closed position where upper surfaces thereof form bottom portions of the tablet receiving measures and to an open position where the tablet passing apertures communicate with the tablet receiving measures to open the lower openings of the tablet receiving measures, and wherein upper surfaces of closing portions of the shutters are processed for enhancing a surface roughness.

6. The medicine packing device of claim 1, wherein an upper surface of the bottom plate is processed for enhancing a surface roughness.

7. The medicine packing device of claim 6, wherein the opening and closing mechanism includes a pair of shutters formed with a plurality of tablet passing apertures corresponding to the tablet receiving measures, the shutters moving to a closed position where upper surfaces thereof form bottom portions of the tablet receiving measures and to an open position where the tablet passing apertures communicate with the tablet receiving measures to open the lower openings of the tablet receiving measures, and wherein upper surfaces of closing portions of the shutters are processed for enhancing a surface roughness.

8. The medicine packing device of claim 1, wherein the opening and closing mechanism includes a pair of shutters formed with a plurality of tablet passing apertures corresponding to the tablet receiving measures, the shutters moving to a closed position where upper surfaces thereof form bottom portions of the tablet receiving measures and to an open position where the tablet passing apertures communicate with the tablet receiving measures to open the lower openings of the tablet receiving measures, and wherein upper surfaces of closing portions of the shutters are processed for enhancing a surface roughness.

* * * * *